US007581357B2

(12) United States Patent
Richardson et al.

(10) Patent No.: US 7,581,357 B2
(45) Date of Patent: Sep. 1, 2009

(54) PLASTIC EXPANDABLE UTILITY SHED

(75) Inventors: Jed C. Richardson, Batavia, IL (US); Lyle A. Rosine, Oswego, IL (US); Rob Stein, Aurora, IL (US); Robert Kopp, Wheaton, IL (US); Michael Uffner, Naperville, IL (US); Torrence Anderson, Overland Park, KS (US)

(73) Assignee: Suncast Corporation, Batavia, IL (US)

( * ) Notice: Subject to any disclaimer, the term of this patent is extended or adjusted under 35 U.S.C. 154(b) by 552 days.

(21) Appl. No.: 11/216,929

(22) Filed: Aug. 30, 2005

(65) Prior Publication Data

US 2007/0044391 A1 Mar. 1, 2007

(51) Int. Cl.
*E04H 1/12* (2006.01)

(52) U.S. Cl. ..... 52/79.5; 52/79.1; 52/79.2; 52/79.3; 52/79.4; 52/79.6; 52/79.7; 52/79.8; 52/79.9; 52/264; 52/284; 52/270; 52/285.1; 52/285.4; 52/591.4; 52/589.1; 52/582.1; 52/592.1; 52/591.5; 52/578.5; 446/85; 446/105; 446/108; 446/110; 446/111; 446/115; 446/116; 446/128; 446/476; 446/478

(58) Field of Classification Search ..... 52/79.1–79.9, 52/264, 284, 270, 285.1, 285.4, 591.4, 589.1, 52/582.1, 592.1, 591.5, 578, 5; 446/85, 105, 446/108, 110, 111, 115, 116, 128, 476, 478
See application file for complete search history.

(56) References Cited

U.S. PATENT DOCUMENTS 3,236,014 A * 2/1966 Edgar ..... 52/270
3,310,919 A * 3/1967 Bue et al. ..... 52/127.11
3,866,381 A 2/1975 Eschbach et al.
4,193,221 A * 3/1980 Beck ..... 446/105
4,557,091 A 12/1985 Auer
5,036,634 A 8/1991 Lessard et al.
D371,208 S 6/1996 De Zen
5,921,047 A * 7/1999 Walker ..... 52/585.1
5,975,660 A * 11/1999 Tisbo et al. ..... 312/263
6,185,878 B1 * 2/2001 Bullard et al. ..... 52/79.5
6,250,022 B1 6/2001 Paz et al.
6,648,542 B2 * 11/2003 Smith et al. ..... 403/291
6,701,678 B1 * 3/2004 Skov et al. ..... 52/79.9
6,802,158 B1 * 10/2004 Greene ..... 52/79.5
6,892,497 B2 5/2005 Moon et al.
2004/0187400 A1 9/2004 Anderson et al.

* cited by examiner

*Primary Examiner*—Jeanette E Chapman
*Assistant Examiner*—Daniel Kenny
(74) *Attorney, Agent, or Firm*—McHale & Slavin, P.A.

(57) ABSTRACT

The present invention provides a system, or kit, of injection molded panels having integrated connectors which combine to form an enclosure, commonly in the form of a utility shed. The panels are formed of injection molded plastic to interlock with one another without the need for separate I-beam connectors. The ends of the wall panels have cavities to accept both roof and floor outwardly projecting locking bosses for interlocking cooperative engagement which serve to rigidly connect the components together. The symmetry of the wall, roof, floor and door components also minimizes component shapes and simplifies enclosure construction.

20 Claims, 42 Drawing Sheets

PLASTIC EXPANDABLE UTILITY SHED

FIELD OF THE INVENTION

This invention relates generally to a large enclosure constructed of plastic structural panels. More specifically, the present invention relates to a modular construction system utilizing injection molded plastic structural panels having integrated connectors to construct various sized enclosures using the same components.

BACKGROUND INFORMATION

Utility sheds are a necessity for lawn and garden care, as well as general all-around home storage space. Typically, items such as garden tractors, snow blowers, tillers, ATVs, motorcycles and the like consume a great deal of the garage floor space available, forcing the homeowner to park his automobile outside.

The prior art has proposed a number of different panel systems, or kits, comprising blow molded or extruded panels and connector members for forming a wide variety of smaller sized storage structures. These structures are generally suitable to store hand tools and smaller lawn equipment. Typically, such systems require extruded metal or plastic connector members having a specific cross-sectional geometry that facilitate an engagement between such members and one or more blow molded plastic panels having a complimentary edge configuration. Due to the nature of the manufacturing process, blow molded plastic components cannot be formed with the intricate shapes and/or sharp corners required for integrated connectors. In addition, blow molded plastic components are hollow and cannot be formed with the integral strengthening ribs and gussets possible with injection molding.

A particularly common structure for the connector members is the I-beam cross section. The I-beam defines free edge portions of the connector member which fit within appropriately dimensioned and located slots in the panel members. U.S. Pat. No. D-371,208, teaches a corner extrusion for a building sidewall that is representative of the state of the art I-beam connector members. The I-beam sides of the connector engage with the peripheral edge channels of a respective wall panel and thereby serve to join such panels together at right angles. Straight or in-line versions of the connector members are also included in the kits to join panels in a coplanar relationship to create walls of varying length.

Extruded components generally require hollow longitudinal conduits for strength. Due to the nature of the manufacturing process the conduits are difficult to extrude in long sections for structural panels. Thus, they require connectors to achieve adequate height for utility shed walls. A common structure for connecting extruded members has a center I-beam with upper and lower protrusions for engaging the conduits. However, wall panels utilizing connectors are vulnerable to buckling under loads and may have an aesthetically unpleasing appearance. Moreover, roof loads from snow and the like may cause such walls to bow outwardly due to the clearances required between the connectors and the internal bores of the conduits. U.S. Pat. No. 6,250,022 discloses an extendable shed utilizing side wall connector members representing the state of the art. The connectors have a center strip with hollow protrusions extending from its upper and lower surfaces along its length; the protrusions being situated to slidably engage the conduits located in the side panel sections to create the height needed for utility shed walls.

The aforementioned systems can also incorporate roof and floor panels to form a freestanding enclosed structure such as a small utility shed. U.S. Pat. Nos. 3,866,381; 5,036,634; and 4,557,091 disclose various systems having inter-fitting panel and connector components. Such prior art systems, while working well, have not met all of the needs of consumers to provide the structural integrity required to construct larger sized structures. Larger structures must perform differently than small structures. Larger structures require constant ventilation in order to control moisture within the building. Large structures must also withstand increased wind and snow loads when compared to smaller structures. Paramount to achieving these needs is a panel system which eliminates the need for extruded connectors to create enclosure walls which resist panel separation, buckling, racking; and a roof system which allows ventilation while preventing weather infiltration. A further problem is that the wall formed by the panels must tie into the roof and floor in such a way as to unify the entire enclosure. Also, from a structural standpoint, the enclosure should include components capable of withstanding the increased wind, snow, and storage loads required by larger structures. From a convenience standpoint, a door must be present which can be easily installed after assembly of the wall and roof components, is compatible with the sidewalls, and which provides dependable pivoting door access to the enclosure. Also from a convenience standpoint, the structure should allow natural as well as artificial lighting. The structure should be aesthetically pleasing in appearance to blend in with surrounding structures.

The assignee of the instant invention is also the assignee of various other plastic enclosure systems, U.S. Pat. No. 6,892,497 entitled Plastic Panel Enclosure System, U.S. patent application Ser. No. 10/674,103 Plastic Expandable Utility Shed, the contents of which are incorporated herein in their entirety.

There are also commercial considerations that must be satisfied by any viable enclosure system or kit; considerations which are not entirely satisfied by state of the art products. The enclosure must be formed of relatively few component parts that are inexpensive to manufacture by conventional techniques. The enclosure must also be capable of being packaged and shipped in a knocked-down state. In addition, the system must be modular and facilitate the creation of a family of enclosures that vary in size but which share common, interchangeable components.

Finally, there are ergonomic needs that an enclosure system must satisfy in order to achieve acceptance by the end user. The system must be easily and quickly assembled using minimal hardware and requiring a minimal number of tools. Further, the system must not require excessive strength to assemble or include heavy component parts. Moreover, the system must assemble together in such a way so as not to detract from the internal storage volume of the resulting enclosure, or otherwise detract from the internal storage volume of the resulting enclosure, or otherwise negatively affect the utility of the structure.

BRIEF DESCRIPTION OF THE INVENTION

The present invention provides a system, or kit, of injection molded panels having integrated connectors which combine to form an enclosure, commonly in the form of a large utility shed. The corner sections, roof, wall and floor panels are formed of injection molded plastic to interlock with one another without the need for separate I-beam connectors. The ends of the wall panels have receptacles to accept both roof and floor bosses for interlocking cooperative engagement to rigidly connect the components together.

The system incorporates a minimum number of components to construct a large heavy duty enclosure by integrally forming connectors into injection molded panels. This minimizes the need for separate extruded or molded connectors to assemble the enclosure. The symmetry of the corner sections, wall, roof, floor and door components also minimizes component shapes and simplifies enclosure construction. The heavy duty interlocking construction of the corner sections and the roof headers create a structural frame that allows construction of larger enclosures. Injection molding the wall panels allow them to be formed with adequate height for a large walk-in enclosure, eliminating the need for stacking panels to achieve such adequate height. Injection molding also allows the panels to be formed with integral cross-bracing, ribs, and gussets for increased rigidity when compared to blow molded or extruded panels.

In one embodiment, the enclosure system utilizes interlocking corner sections, roof headers, and floor panels to create a structural frame. Three types of panel constructions are integrated into the structural frame: the first being utilized for the side walls, the second being used for the door assembly, and the third being used for the roof. The wall panels are constructed to cooperate, via integrally formed connectors, with various members which allow the wall panels to be utilized for door frames as well as corner sections. The wall panels are also constructed to accept windows for natural lighting, and may include provisions for standard electrical current hookup. The internal surfaces of the wall panels include integrally formed connectors for easy assembly of added components such as shelving, baskets, slat wall storage and the like. The embodiment also incorporates a vented gabled roof assembly with anti-lift wind strapping and steel reinforcement. The system further includes a door assembly which may be locked in an open or closed position. The floor of the system is primarily constructed of a single type of floor panel in combination with front and rear edge assemblies to permit construction of sheds having various predetermined lengths and widths. The same wall, floor and roof components are used to create an entire family of utility enclosures of varying size, and the assembly of the system requires minimal hardware and a minimum number of hand tools.

Accordingly, it is an objective of the present invention to provide a utility enclosure system which utilizes plastic structural frame and panel members having integrated connectors for creating larger enclosures of varying dimension using common components.

A further objective is to provide a utility enclosure system wherein the structural panel members include integrated connectors which accommodate injection molding plastic formation of the panel components for increased structural integrity.

Yet a further objective is to provide a utility enclosure system which utilizes structural corner assemblies for increased enclosure rigidity.

Another objective is to provide a utility enclosure system constructed with panels having interlocking bosses and pockets as well as ridge and groove edges to increase rigidity and prevent panel bowing or separation.

Yet another objective is to provide a utility enclosure system which reduces the number of components required to assemble an enclosure and simplifies construction.

Still yet another objective is to provide a utility enclosure system constructed and arranged with panels that allow wood and/or steel supports to be easily incorporated therein for increased snow and/or wind load resistance.

An even further objective is to provide a utility enclosure system constructed and arranged to allow airflow through the enclosure while preventing weather related moisture from entering the enclosure.

Yet a further objective is to provide a utility enclosure system which may be optionally configured with clear windows thereby allowing natural light to enter the enclosure.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENTS

Figure 1:
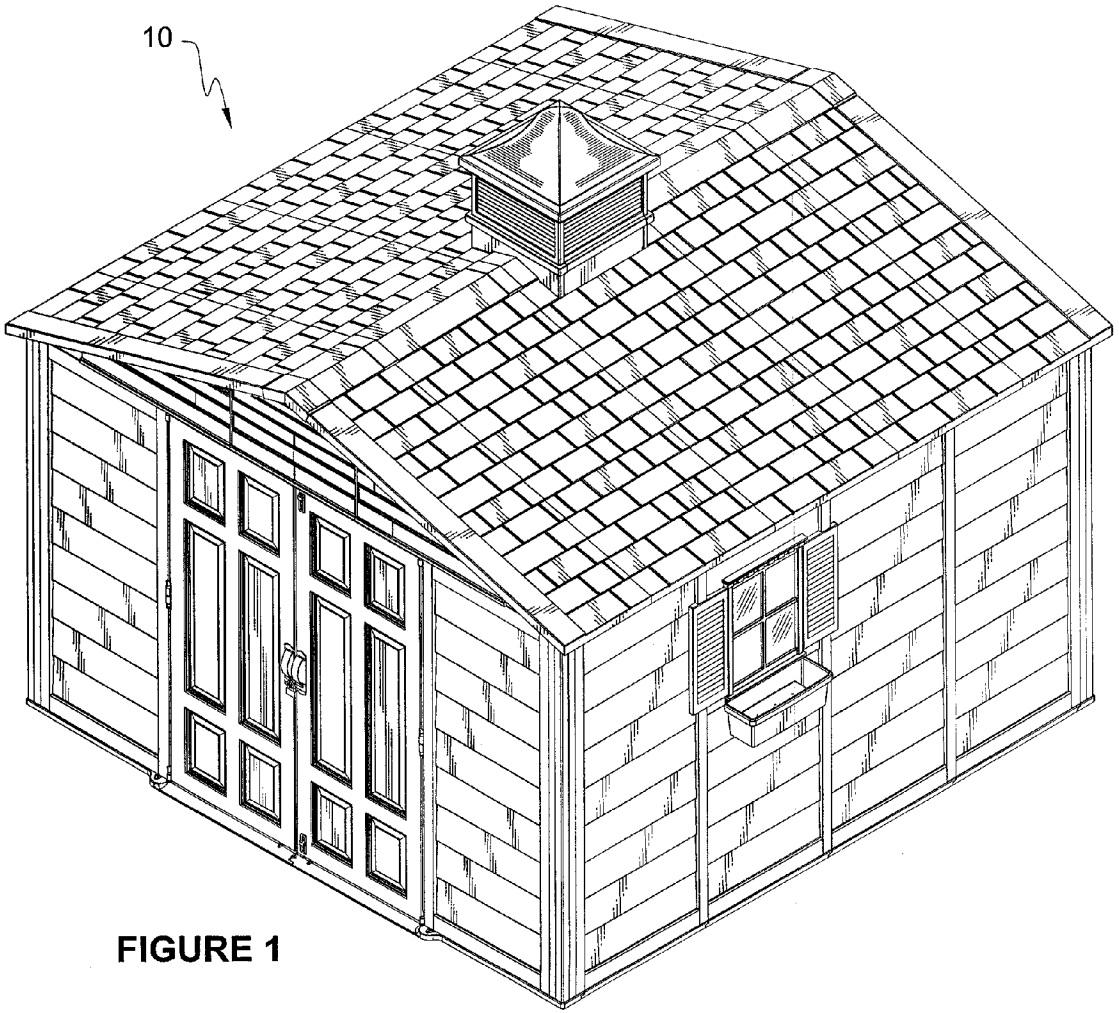
FIG. 1 is a front perspective view of an enclosure constructed using the instant utility enclosure system.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Figure 2:
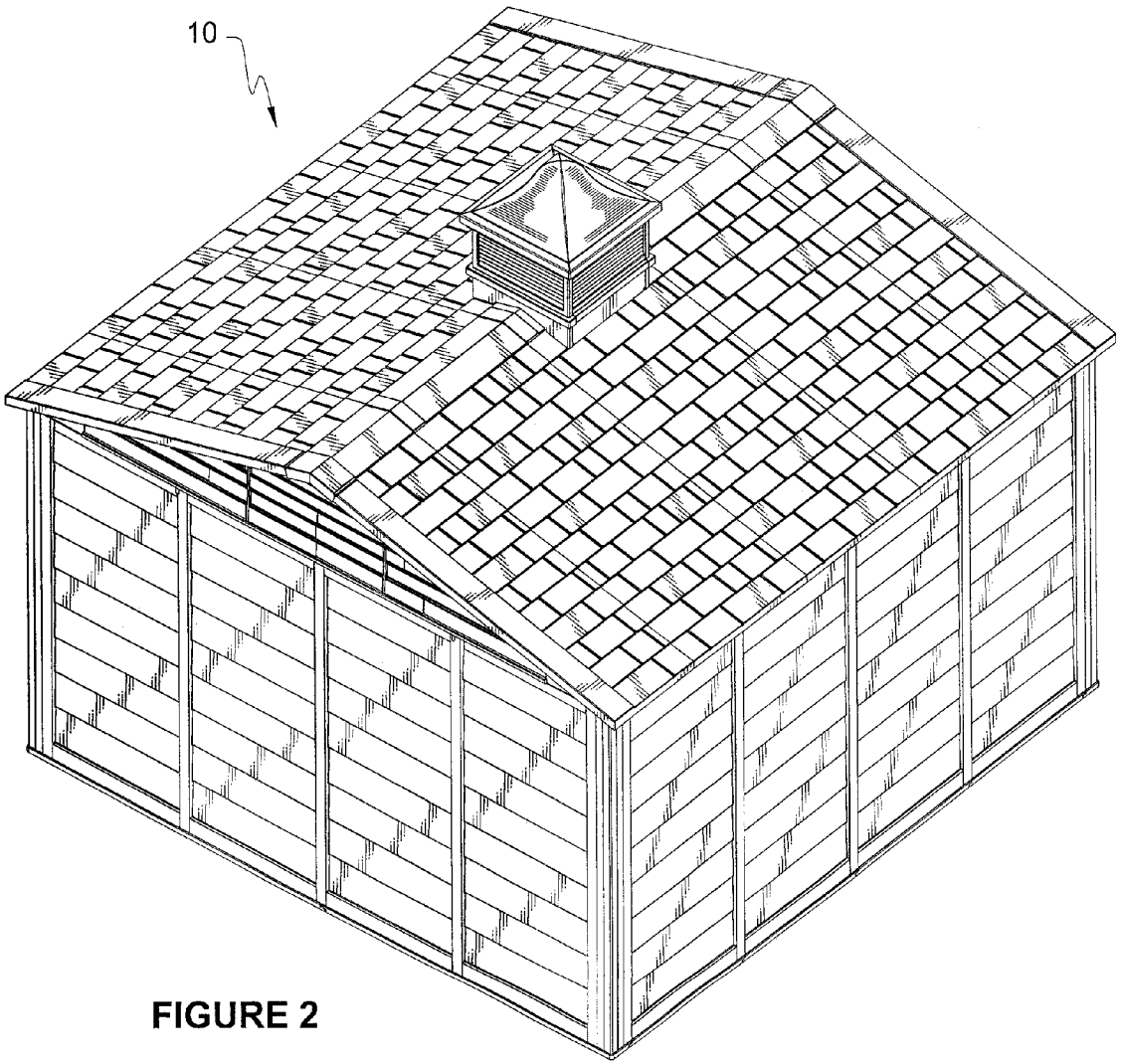
FIG. 2 is a rear perspective view of an enclosure constructed using the instant utility enclosure system.
Figure 3:
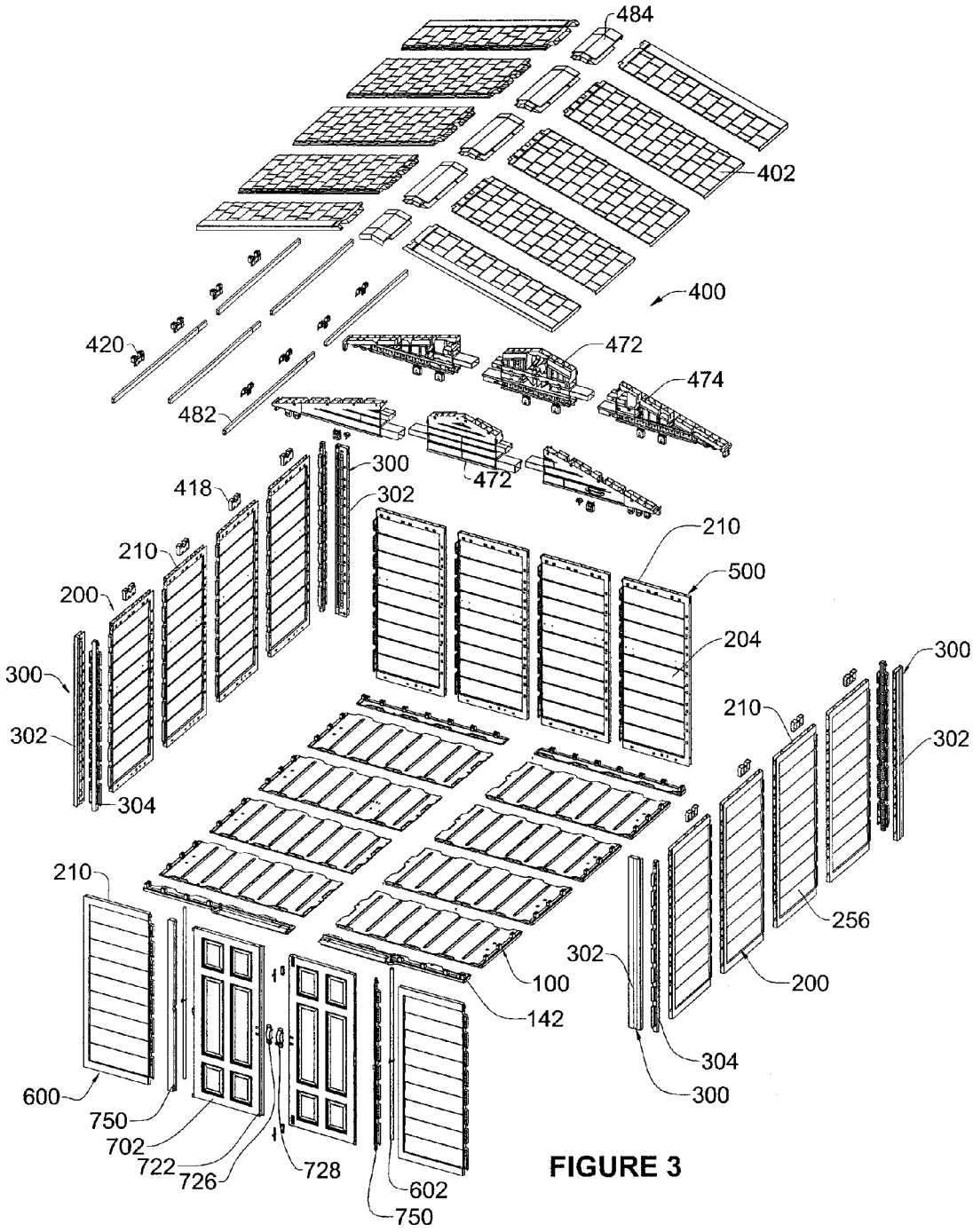
FIG. 3 is an exploded view of the enclosure shown in FIG. 1.
Figure 4:
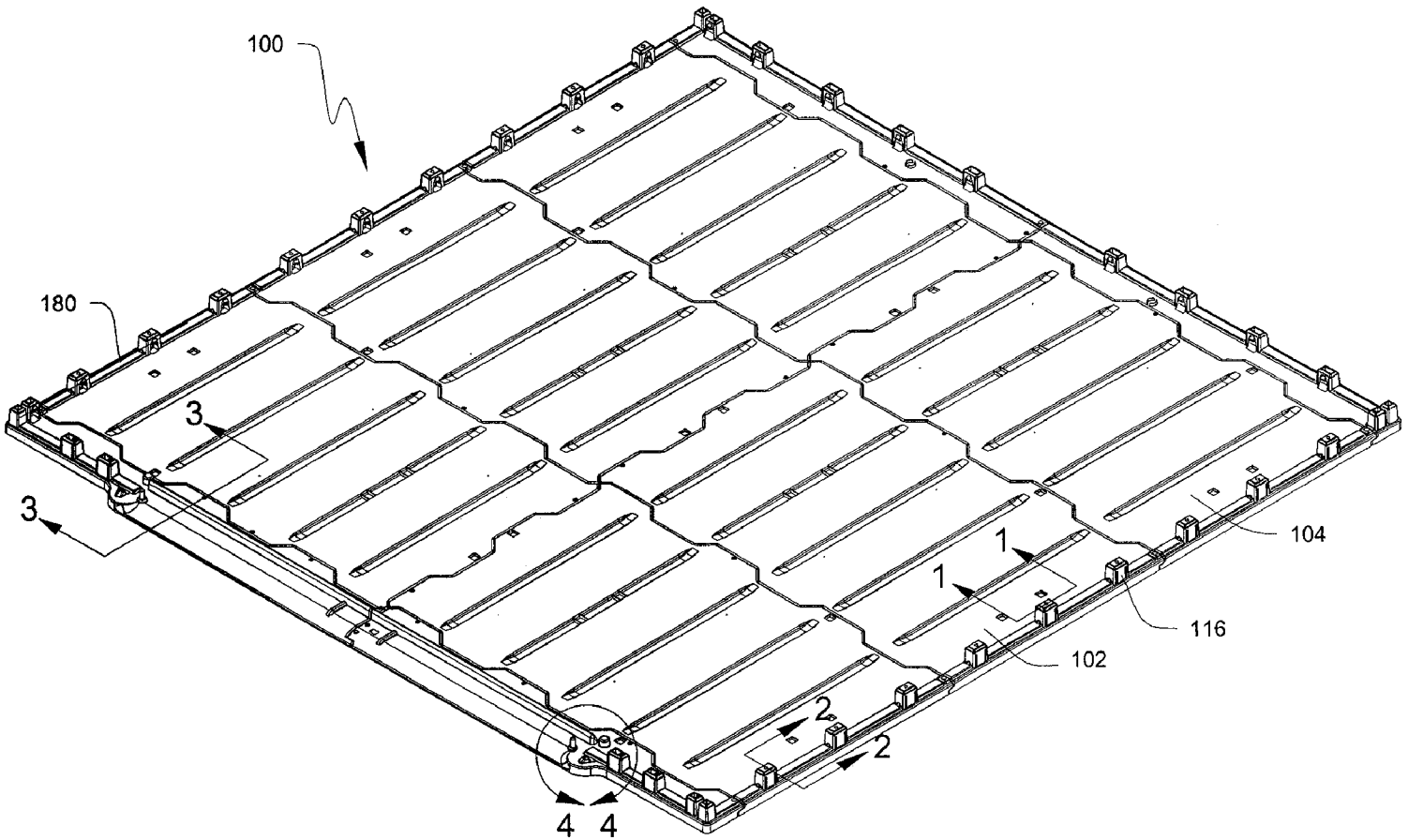
FIG. 4 is a perspective view of one embodiment of the floor assembly utilized in the instant invention.
Figure 5:
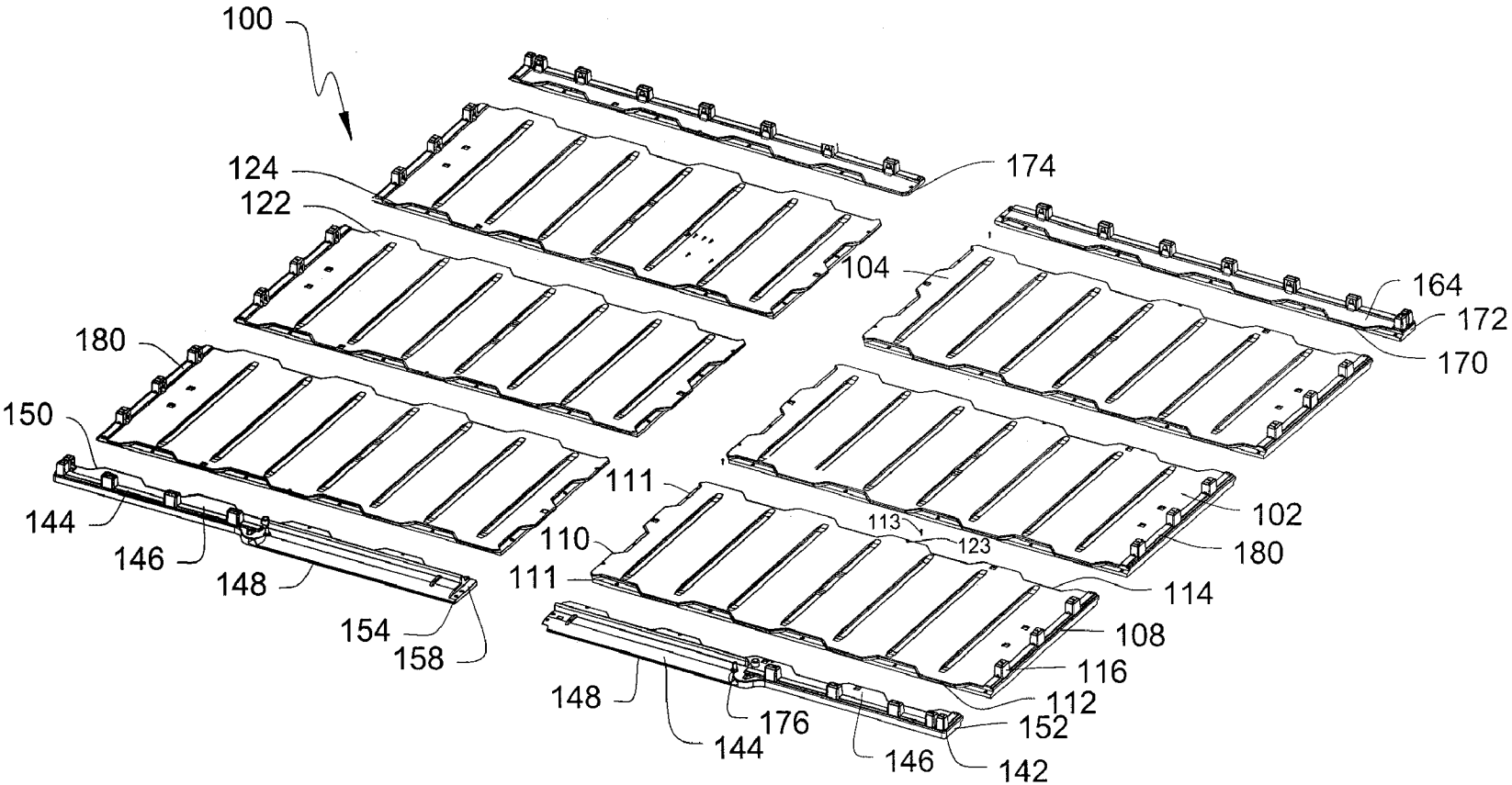
FIG. 5 is an exploded perspective view of the floor assembly shown in FIG. 4.

FIGS. 1-3 which are now referenced show isometric and exploded views of a heavy duty utility enclosure, generally referenced as 10, constructed according to a preferred embodiment of the present invention. The enclosure is made up of a floor assembly 100, left and right side wall assemblies 200, corner post assemblies 300, roof assembly 400, rear wall assembly 500, front wall assembly 600 and door assemblies 700. In the preferred embodiment, the panels comprising the assemblies are formed of but not limited to a suitable plastic such as polystyrene, polypropylene or polyethylene, through the process of injection molding. The result is that the panels comprising the floor assembly 100, post assemblies 300, side wall assemblies 200, roof assembly 400, rear wall assembly 500 and front wall assembly 600 of the enclosure 10 are formed as unitary panels with integral connectors and cross bracing. Strengthening ribs and gussets 206 are formed within the inner surfaces of the various panels and components in order to enhance rigidity of the panels while leaving the external surface in a generally smooth condition for aesthetic purposes, as shown in FIG. 1. The injection molded construction is utilized for the floor assembly 100, left and right wall assemblies 200, the corner posts 300, roof assembly 400, rear wall assembly 500, and front wall assembly 600 using a minimal number of components.

Referring to FIGS. 1-10, the enclosure includes a plurality of like-constructed floor panels 102. Each panel has a top surface 104, bottom surface 106, a closed first edge 108, a second edge 110 opposite said first edge, said second edge including a first means for connecting to juxtapositioned panel members, a third edge 112 substantially perpendicular to and extending between said first and said second edges, the third edge including the first means for connecting to juxtapositioned panel members, and a fourth edge 114 opposite to and substantially parallel to said third edge, the fourth edge including the first means for connecting to juxtapositioned panel members. Adjacent to the closed edge 108 is a second means of attaching the floor assembly to the wall assemblies illustrated herein as a plurality of bosses 116 extending upwardly from the top surface 104. The bosses 116 are constructed and arranged to cooperate with pockets 210 located at each longitudinal end of the structural wall panels 202 and the structural L-shaped post assemblies 300 for connecting and maintaining a substantially perpendicular relationship between the wall panel members and the top surface of the floor panel members. Within the preferred embodiment, the locking bosses 116 are removeable and replaceable, wherein each locking boss includes a first lower end 130 and a second upper end 132. The first end includes a flange 134 constructed and arranged to cooperate with a floor panel to provide a secure connection between the panels and to prevent lifting or tipping of wall panels secured thereto. The locking boss is inserted through a conjugately shaped aperture 136 integrally formed within the floor panels until the integrally formed spring clips 138 engage surface 140 for a secure connection, wherein the locking boss extends upwardly above the top surface of the floor panel.

Along the edges 110, 112, and 114 of each floor panel 102 is the first means of connection illustrated herein as a series of spaced apart fingers 122 and recesses 124 for attaching the panels together into a floor assembly 100, a portion of the fingers being provided with at least one countersank aperture 123 for receiving a fastener 113. The fingers 122 and recesses 124 are constructed and arranged so that the fingers 122 of one panel overlap and mateably engage the recesses 124 of an adjacently positioned panel. The fasteners secure the panels together in an inter-fitting engagement with their respective top surfaces 104 in a co-planar arrangement. In a most preferred embodiment a portion of the fingers include an alignment boss 115 (FIG. 9) projecting outwardly from a lower surface thereof. The alignment boss 115 mateably engages an alignment socket 117 positioned within an upper surface of an aligned recess 124. In one embodiment the alignment boss may include an integrally formed spring clip (not shown) for interlocking engagement with the alignment socket 117.

The floor panels 102 are interconnected to each other to form a utility shed floor assembly 100 having a width determined by the width of the panels and length determined by the number of panels assembled. The panels are assembled by juxtapositioning the edges of respective floor panels and sliding the fingers of one panel into the respective recesses of the adjacent panel while simultaneously engaging the alignment bosses into their respective sockets. The fingers 122 and recesses 124 along the second, third, and fourth edges of the floor panels 102 correspond in shape and size to that of the fingers and recesses integrally formed into the adjacently positioned panels. The result is a positive mechanical connection between the floor panels to create the floor assembly 100. In this manner the length of the shed may be increased or decreased to suit the users needs by adding or subtracting the number of panels assembled.

Figure 6:
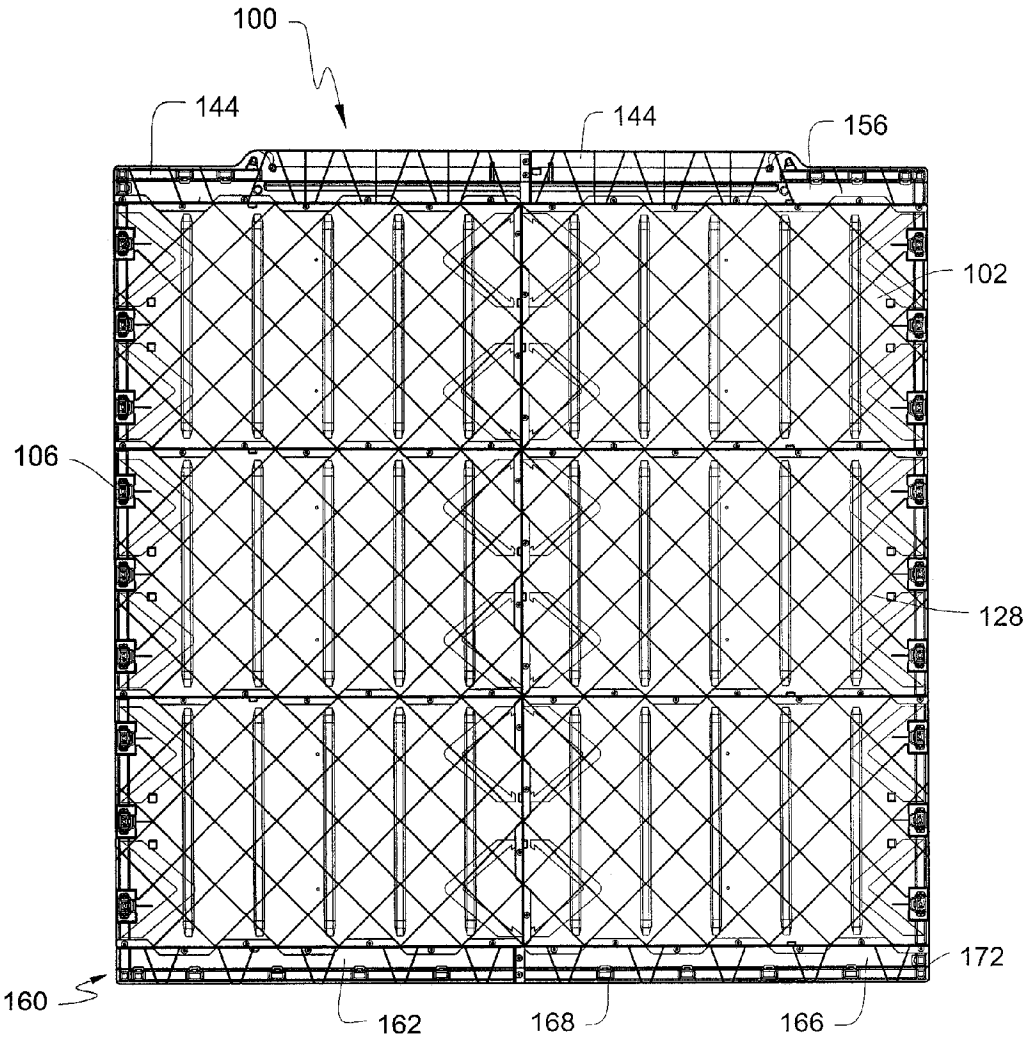
FIG. 6 is a bottom view of the floor assembly illustrating the integrally formed cross-bracing.
Figure 7:
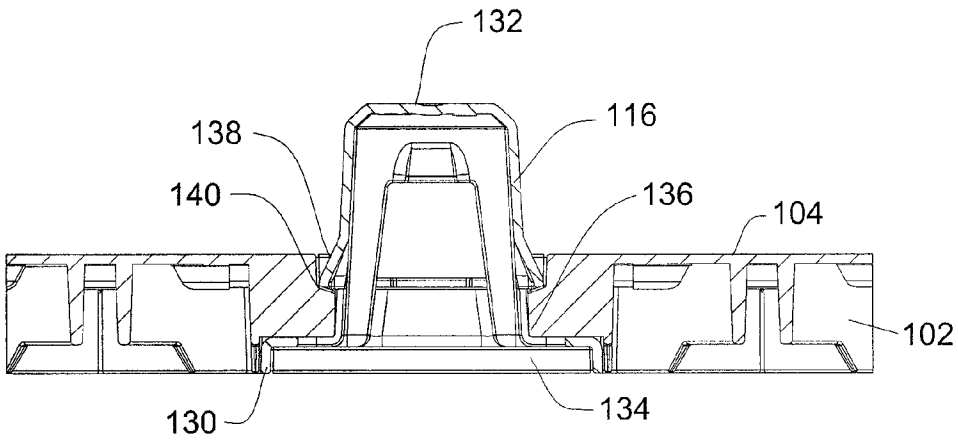
FIG. 7 is a partial section view taken along line 1-1 of FIG. 4, illustrating the connection between a floor panel and a locking boss.
Figure 8:
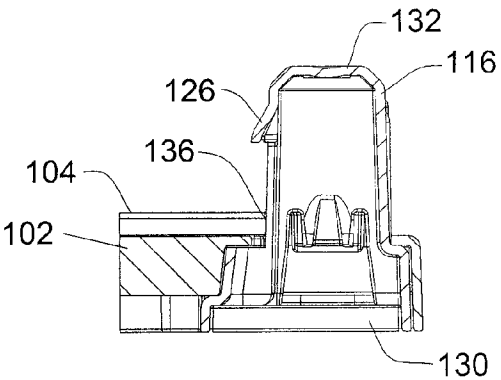
FIG. 8 is a partial section view taken along line 2-2 of FIG. 4, illustrating the connection between a floor panel and a locking boss.
Figure 9:
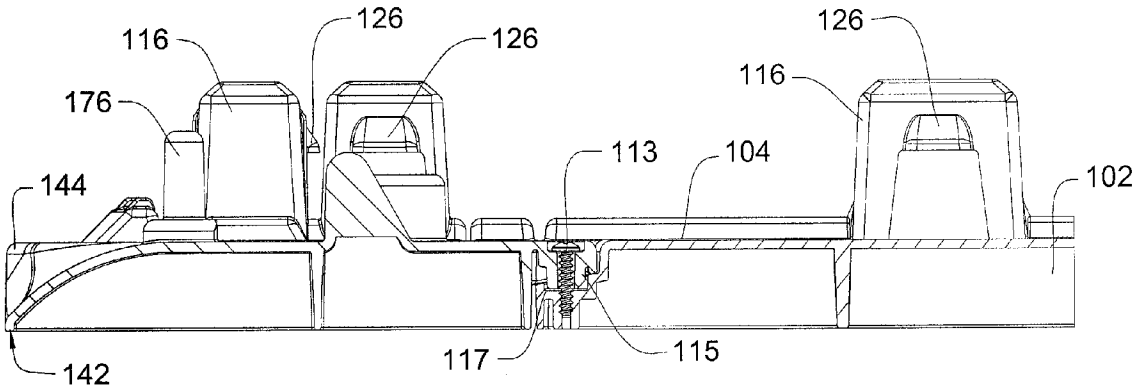
FIG. 9 is a partial section view taken along line 3-3 of FIG. 4, illustrating the connection between a floor panel and a front end assembly.
Figure 10:
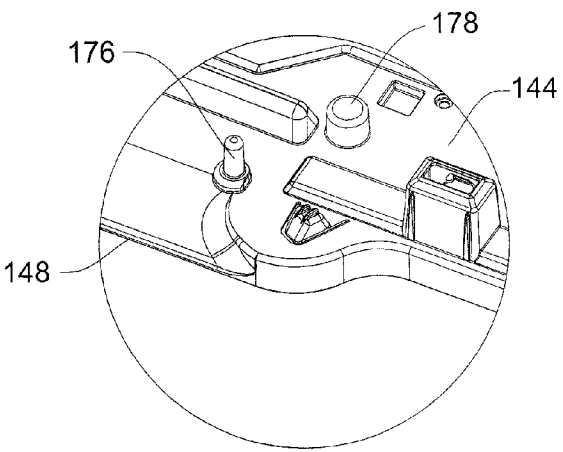
FIG. 10 is a partial perspective view taken along line 4-4 of FIG. 4, illustrating the lower hinge pin, door catch feature, a portion of the roof support structure, door gap seal, and wall key as utilized in the instant invention.

Referring to FIG. 6, the bottom surface of the floor assembly 100 is illustrated. The bottom surface 106 illustrates the cross-bracing 128 facilitated by injection molding of panels. Injection molding offers significant strength and stability advantages over blow-molding as utilized in the prior art. In this manner, the enclosure of the instant invention is capable of handling a significant amount of weight as compared to blow molded or extruded enclosures.

Referring to FIGS. 1-10, in addition to the floor panels, the floor assembly includes a front end assembly 142. The front end assembly preferably includes two front end members 144. Each front end member includes a top surface 146, a bottom surface 156, a first ramp edge 148, a second edge 150 opposite the first edge, an outer edge 152, a an inner edge 154. The second edge includes the first means of connection whereby the front end members may be juxtapositioned in interlocking engagement with assembled floor panel members 102 to finish the front portion of the floor assembly 100. The inner edges 154 include a third means of connection for connecting to the inner edge of an adjacently positioned front end member, illustrated herein as an overlapping arrangement which includes fasteners to facilitate mechanical connection. It will be appreciated that the purpose of the overlapping arrangement is to align two panels in an interlocking co-planar relationship and to facilitate their mechanical connection. The result is a mechanically secure connection between the two panels that resists separation when traversed with heavy loads. Adjacent to each of the ramp edges 148 is a pair of generally cylindrical hinge pins 176 extending upwardly. The hinge pins 176 cooperate with the door panels 702 to allow pivotal movement. Adjacent to each of the hinge pins is a cylindrical boss 178 constructed and arranged to cooperate with a roof support pillar 602. The roof support is generally tubular and sized to encircle the cylindrical boss 178 as well as a like constructed cylindrical boss positioned on the bottom surface of the header assembly 450 (FIG. 28) to provide increased wind and snow load capacity to the enclosure.

Referring to FIGS. 1-10, in addition to the floor panels, the floor assembly includes a rear end assembly 160. The rear end assembly preferably includes two rear end members 162. Each rear end member includes a top surface 164, a bottom surface 166, a rear closed edge 168, a second edge 170 opposite the first edge, an outer edge 172, and an inner edge 174. The second edge includes the first means of connection whereby the front end members may be juxtapositioned in interlocking engagement with assembled floor panel members 102 to finish the rear portion of the floor assembly 100. The inner edges 174 include the third means of connection for connecting to the inner edge of an adjacently positioned rear end member, illustrated herein as an overlapping arrangement which includes fasteners to facilitate mechanical connection. It will be appreciated that the purpose of the overlapping arrangement is to align two panels in an interlocking co-planar relationship and to facilitate their mechanical connection. The result is a mechanically secure connection between the two panels that resists separation.

Figure 11:
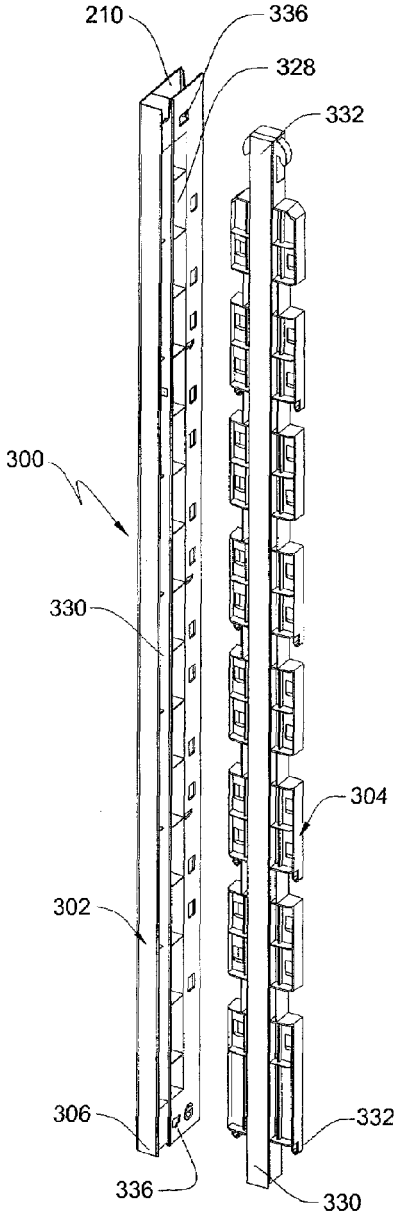
FIG. 11 is a perspective view illustrating one of the corner posts utilized in the instant invention.
Figure 13:
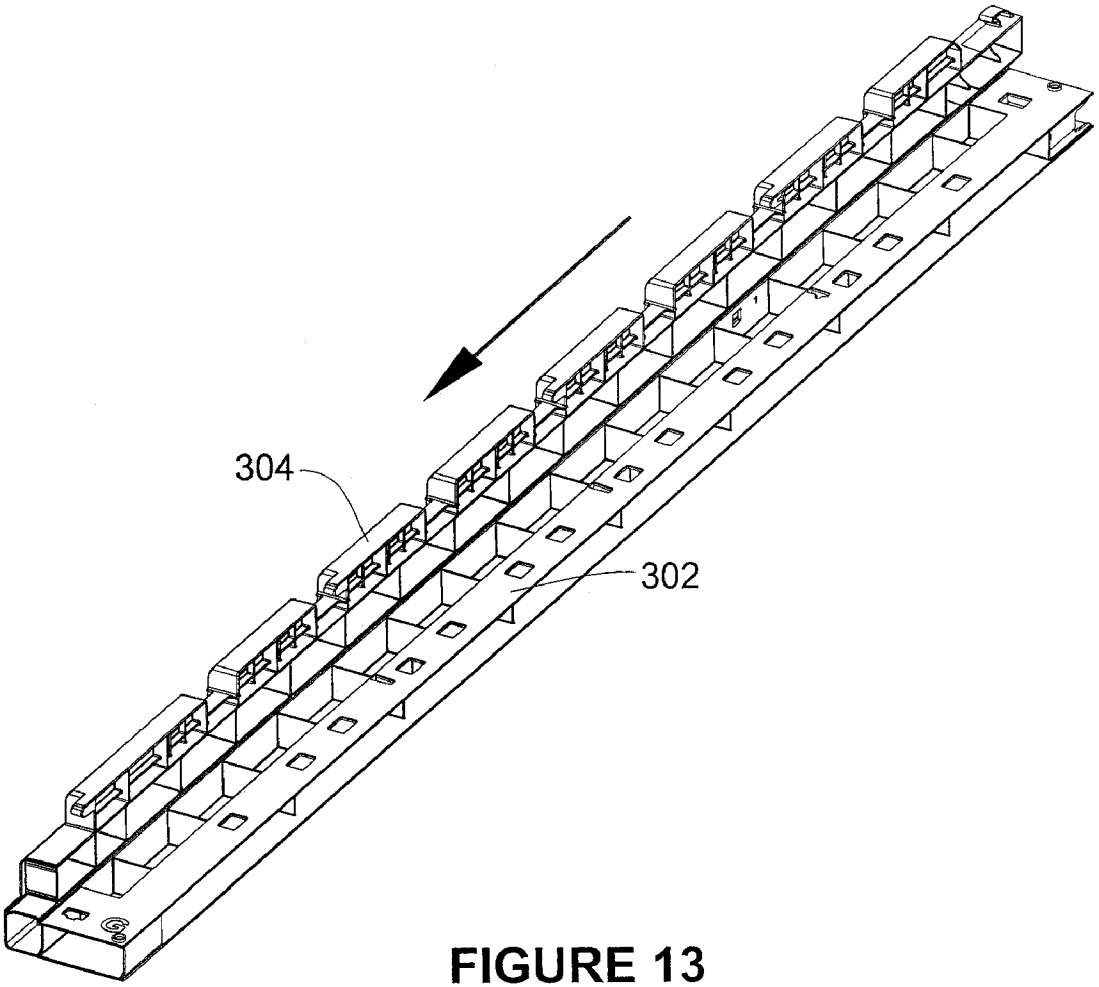
FIG. 13 is a perspective view illustrating assembly of first and second corner post members.

Referring to FIG. 11, a structural corner post assembly 300 is shown. The corner post assembly 300 constitutes one of a plurality of like-configured structural corner post assemblies in the system used to add significant strength and rigidity to the enclosure 10. The corner post assemblies 300 are generally L-shaped having a first member 302 extending at least partially along the front or rear wall of the enclosure and a second member 304 extending at least partially along a side wall of the enclosure. The first corner post members 302 are each configured having a first longitudinal end 306 and a second longitudinal end 308 each including an integrally formed fourth means of attachment illustrated herein as an inwardly extending socket 210. The socket is generally constructed and arranged to cooperate with either a floor assembly 100 or a roof assembly 400 boss in a generally perpendicular relationship. To facilitate mechanical connection with other structural panel members 202 in a co-planar relationship the first post member is provided a first horizontal edge 314 including a fifth means of attachment illustrated herein as a plurality of inwardly extending sockets 330. The sockets include an inner wall 316, an outer wall 318, and a bottom wall 320. The bottom wall includes an aperture 321 or notch therethrough for cooperative engagement with a hook-lock 322 included on an adjacently positioned wall panel or second corner post member 304. In the preferred embodiment the horizontal edge 314 also includes a groove 324 extending from about the first longitudinal end 306 to about the second longitudinal end 308 of the edge 314. The groove 324 is arranged to cooperate with a wall panel member 202 having a complimentary ridge in an interlocking coplanar relationship. The second member 304 includes a first end 330 and a second end 332. Extending outward along the length of the second member is a plurality of bosses constructed and arranged to cooperate with sockets 330 integrally formed into the side of the first member 302. A portion of the bosses include integrally formed hook-locks 322 for cooperation with the apertures or notches 321 provided in the first member or wall panels. The first and second members are attached together by sliding the bosses of the second member into the sockets of the first member and thereafter sliding the second member downward to engage the hook-locks (FIG. 13). The result is a positive mechanical connection between the first member of the post 302 and the second member of the post 304. The outer surface 326 of the corner post assemblies 300 are constructed generally smooth for aesthetic appearance, while the internal portion of the assembly includes a plurality of box structures 328 for added strength, rigidity and weight carrying capacity. The construction of the corner post assemblies increase the structural integrity of the enclosure 10 by preventing the corner posts 300 from bowing or bending inwardly or outwardly, and thus, adversely affecting the appearance or operation of the enclosure 10.

The L-shaped corner post assemblies 300 are attached to the interconnected floor assembly 100 by sliding the first longitudinal end of the corner post assembly over a plurality of the bosses 116 extending outwardly from the floor assembly 100. The pockets 210 in each end of the panels 302 correspond in shape and size to that of the bosses 116 and spring tabs 126 (FIG. 9) integrally formed into the bosses 116 align with apertures 336 in the pockets 210 to engage the corner post assembly 300. The result is a positive mechanical connection between the corner post assemblies 300 and the floor assembly 100.

Figure 14:
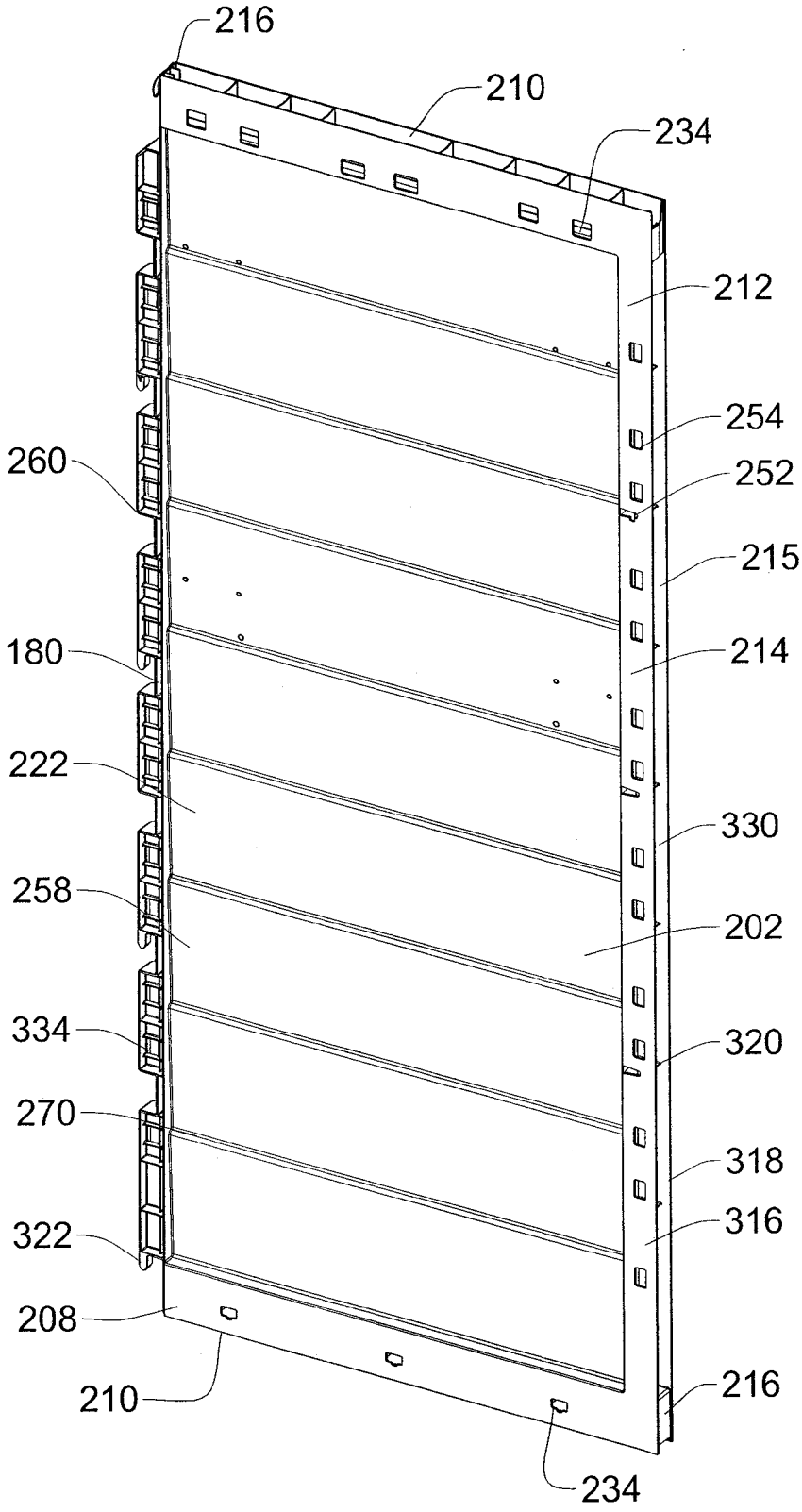
FIG. 14 is a rear perspective view illustrating a wall panel.

Referring to FIGS. 3 and 14, a structural wall panel 202 is shown. The wall panel 202 constitutes one of a plurality of like-configured panels in the system used to construct the left, right, front and rear wall assemblies 200, 500, 600. The structural wall panels 202 are each configured having a first longitudinal end 208 including an integrally formed fourth means of attachment illustrated herein as a plurality of sockets 210. A second longitudinal end 212 also including an integrally formed fourth means of attachment illustrated herein as a plurality of sockets 210. The sockets 210 are generally constructed and arranged to cooperate with either a floor assembly 100 or a roof assembly 400 to facilitate mechanical connection in a generally perpendicular relationship. The outer surface 256 and inner surface 258 of the panels 202 are constructed generally smooth having a plurality of ribs 260, extending from the first edge 214 across the panel 202 to the second edge 222, for added strength and aesthetic appearance. The ribs 260 increase the structural integrity of the enclosure 10 by preventing the panels 202 from bowing or bending, inwardly or outwardly and thus, adversely affecting the appearance or operation of the enclosure 10.

Figure 12:
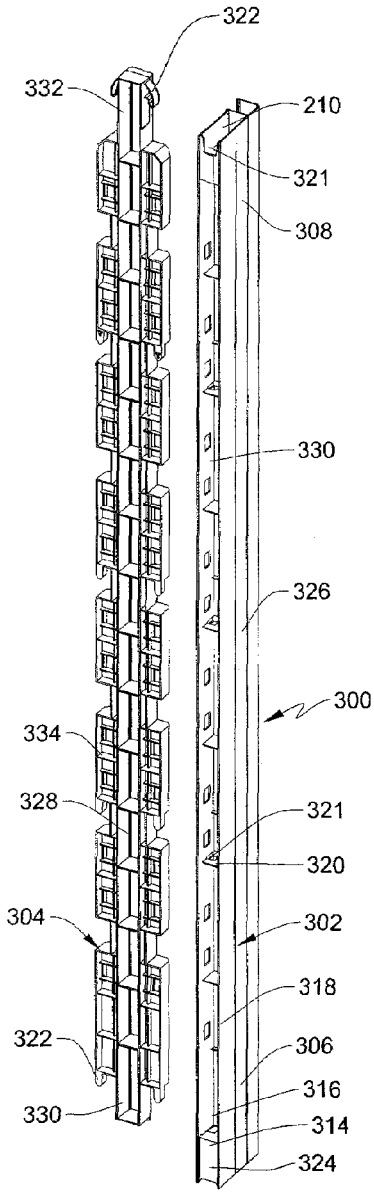
FIG. 12 is a perspective view illustrating one of the corner posts utilized in the instant invention.

To facilitate mechanical connection with other structural wall panel members 202 in a co-planar relationship the panels are provided a first horizontal edge 214 constructed with a fifth means of attachment illustrated herein as a plurality of sockets 330. The sockets include an inner wall 316, an outer wall 318, and a bottom wall 320. The bottom wall includes an aperture 321 (FIG. 12) or notch therethrough for cooperative engagement with a hook-lock 322 included on an adjacently positioned wall panel or corner post. For additional structural rigidity between the side wall panels or between the side wall panels and the floor assembly, the wall panels may also include a groove 216. The groove extends along first and second longitudinal ends as well as along the first horizontal edge of the panels. The groove 216 is arranged to cooperate with a corner post assembly 300, wall panel member 202, or floor assembly 100 having a complimentary ridge 180 in an interlocking coplanar relationship. The ridge 180 extends from about the first longitudinal end 208 of each panel to about the second longitudinal end 212 of each panel along the second edge 222 of the panels. An additional ridge 180 (FIGS. 4 and 5) extends around the perimeter of the floor assembly. The cooperation between the floor assembly ridge and wall panel groove provides a weather and insect resistant seal around the lower perimeter of the enclosure.

The second horizontal edge 222 of each wall panel is constructed generally flat having a plurality of outwardly extending bosses 334. The bosses are constructed and arranged to cooperate with sockets 330 integrally formed into the second edge of the wall panel 202. A portion of the bosses include integrally formed hook-locks 322 for cooperation with the apertures or notches 321 provided in the first member of the corner post assembly or first edge of the wall panels. In addition, the side surfaces of the bosses may include a ramp-lock 250 (FIG. 17) having a ramping surface 254 constructed to cooperate with apertures 252 positioned along the inner wall 316.

Figure 16:
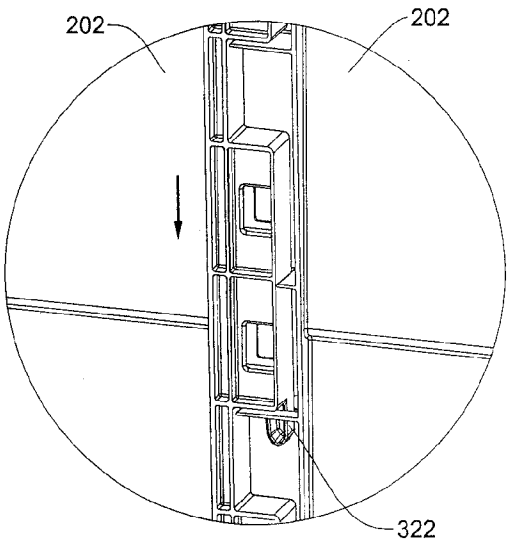
FIG. 16 is a partial section view illustrating the assembly of adjacently positioned wall panels.

Referring to FIGS. 14-17, engagement of the bosses 334 and sockets 330 is illustrated. The wall panels 202 are attached together by sliding the bosses of one panel into the sockets of an adjacently positioned wall panel (FIG. 15) and thereafter sliding the wall panel downward to engage the hook-locks (FIG. 16). In addition to engagement of the hook-locks, the downward motion preferably causes the ramping surface 254 to flex the inner wall 316 until the ramp-lock 250 slips through aperture 252 allowing the inner wall to return to its normal position, locking the wall panels in an engaged position. The result is a positive mechanical connection between the wall panels. The overlapping connection between the panels resists weather infiltration and prevents lifting of the panels under high wind loads.

Figure 15:
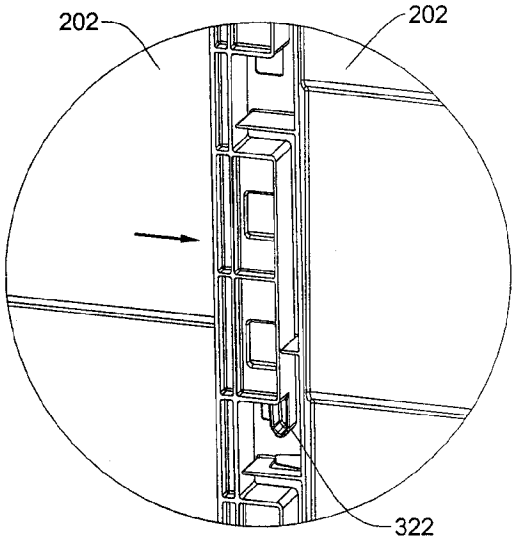
FIG. 15 is a partial section view illustrating assembly of adjacently positioned wall panels.

Referring to FIGS. 15-17, and 20, a door frame 750 member is attached to a wall panel 202. The door frame member includes at least one hinge pin conduit 718 and a pair of hinge pin clearance pockets 728 integrally formed thereto. The door frame member also includes a door seal 752 integrally formed thereto to provide a weather resistant seal to the door assembly 700. The wall panel 202 and the door frame member 750 are attached together by sliding the bosses of the panel into the sockets of the adjacently positioned door frame member, as shown in FIG. 15, and thereafter sliding the wall panel downward to engage the hook-locks, as shown in FIG. 16. In addition to engagement of the hook-locks, the downward motion preferably causes the ramping surface 254 to flex the inner wall 316 until the ramp-lock 250 slips through aperture 252 allowing the inner wall to return to its normal position locking the wall panels in an engaged position. The result is a positive mechanical connection between the wall panel and the door frame member 750.

Figure 17:
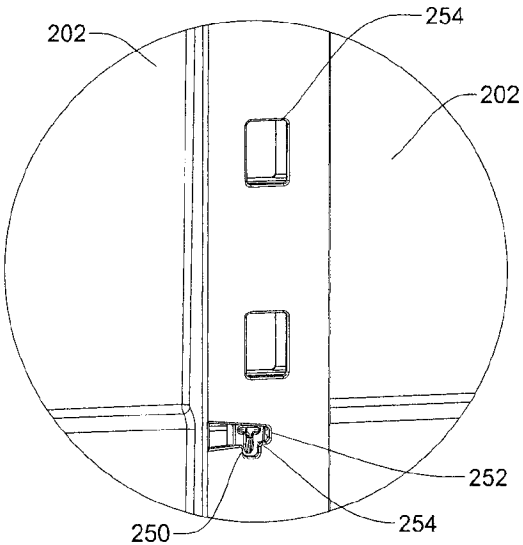
FIG. 17 is a partial view illustrating the assembled wall panels.
Figure 21:
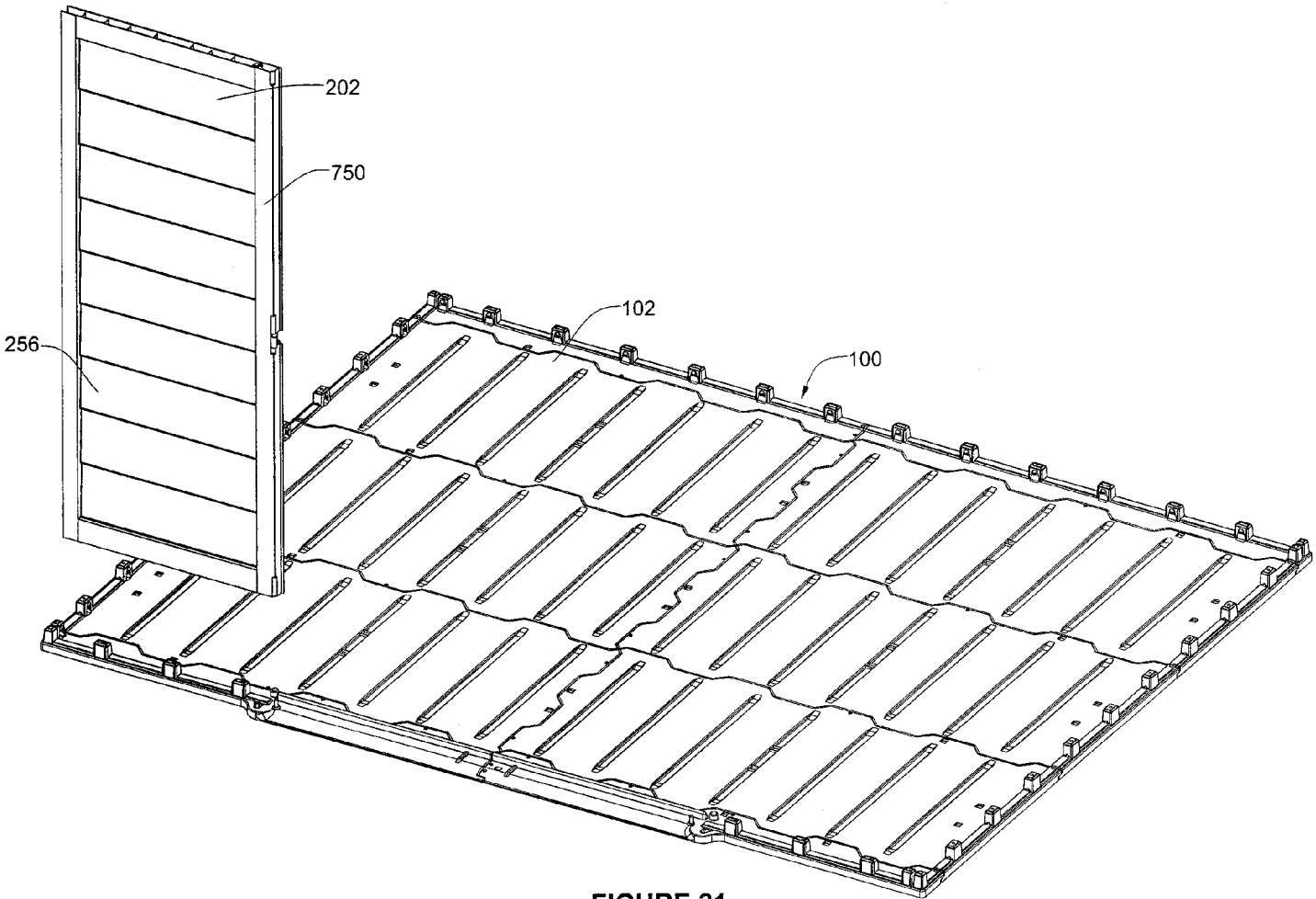
FIG. 21 is a perspective view illustrating assembly of a wall panel to the floor assembly.
Figure 22:
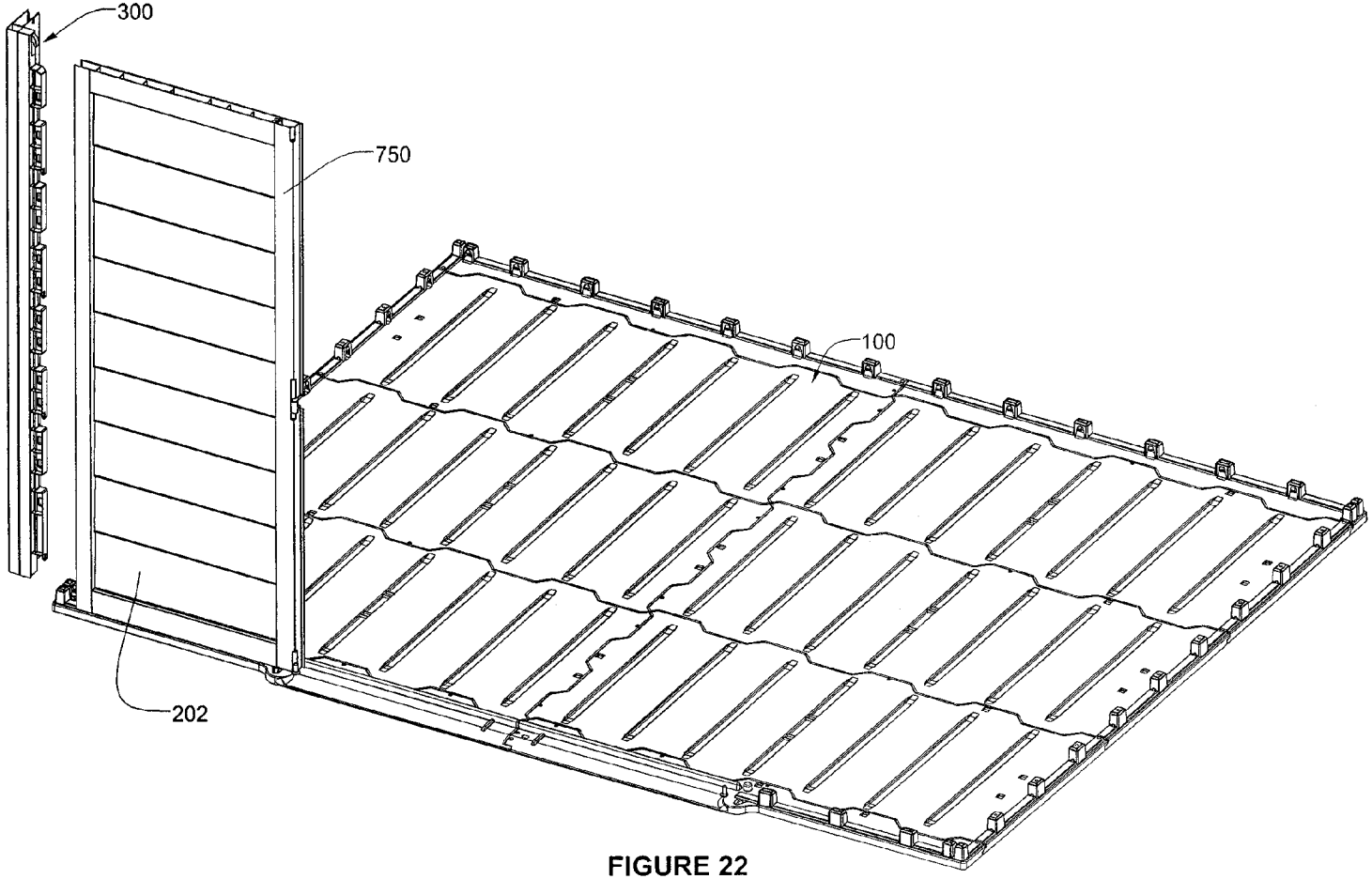
FIG. 22 is a perspective view illustrating assembly of the corner post assembly to the wall panels and floor assembly.
Figure 23:
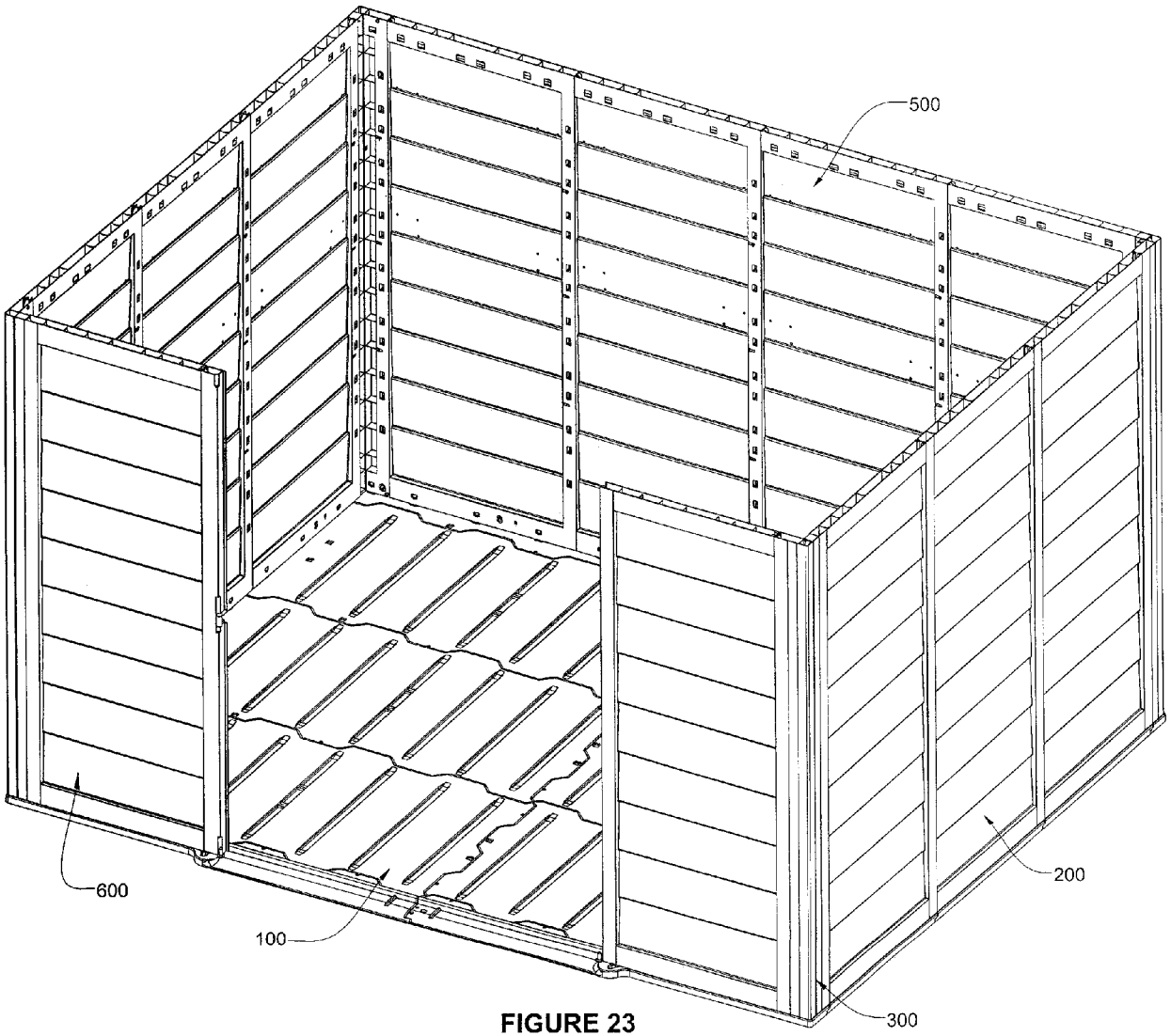
FIG. 23 is a perspective view illustrating the assembled wall and floor panels.

Referring to FIGS. 21-23, the wall panels 202 are attached to the interconnected floor-panels 102 and corner post assemblies 300 by sliding the first longitudinal end of a wall panel 208 over a plurality of the bosses 116. The pockets 210 in each end of the panels 202 correspond in shape and size to that of the bosses 116 and spring tabs 126 (FIG. 8) integrally formed into the bosses 116 align with apertures 234 in the pockets 210 to engage the wall panel 202. The result is a positive mechanical connection between the wall-panels 200 and the floor assembly 100. The first wall panel being attached to the floor assembly 100 and the corner post assembly 300 with the first longitudinal end 208 downward interlocking the two panels via the ridge, groove and boss arrangement extending along the sides of the wall panels. The second wall panel is thereafter attached in a coplanar relationship to the first panel interlocking the two panels via the ridge, groove, and boss arrangement extending along the sides of the wall panels. It will be appreciated that the purpose of the ridge 180 and the groove 216 arrangement is to align two panels in an interlocking co-planar relationship and to facilitate their mechanical connection. The ridge 180 and the groove 216 are brought into an interlocking relationship wherein the ridge 180 enters the corresponding groove 216 (FIG. 17). The result is a mechanically secure connection between the two panels. The interlocking edges between the panels as described above provides a secure connection and offers several advantages. First, the design allows the panels to be connected without the need for I-beam connectors. Second, the design allows the panels to be formed at sufficient height for a walk-in enclosure by creating a positive lock that prevents separation of the panels. Third, the design maintains alignment of the panels in the same plane and prevents bowing or bending of either panel relative to one another. Fourth, the design provides a sealed connection between the panels preventing weather infiltration. The resultant wall created by the combination of the interlocking wall panels benefits from high structural integrity and reliable operation.

Figure 19:
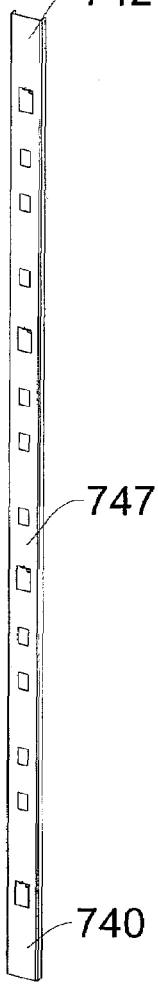
FIG. 19 is a perspective view illustrating the outer surface of a reinforcement channel as utilized in the instant invention.
Figure 18B:
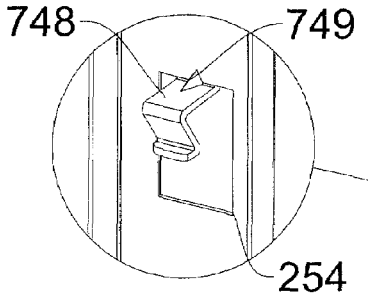
FIG. 18B is a partial perspective view illustrating the reinforcement channel in engagement with a wall assembly.
Figure 18A:
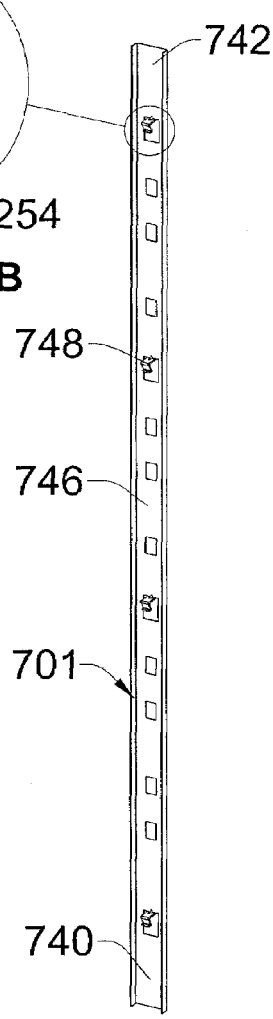
FIG. 18A is a perspective view illustrating the inner surface of a reinforcement channel as utilized in the instant invention.
Figure 20:
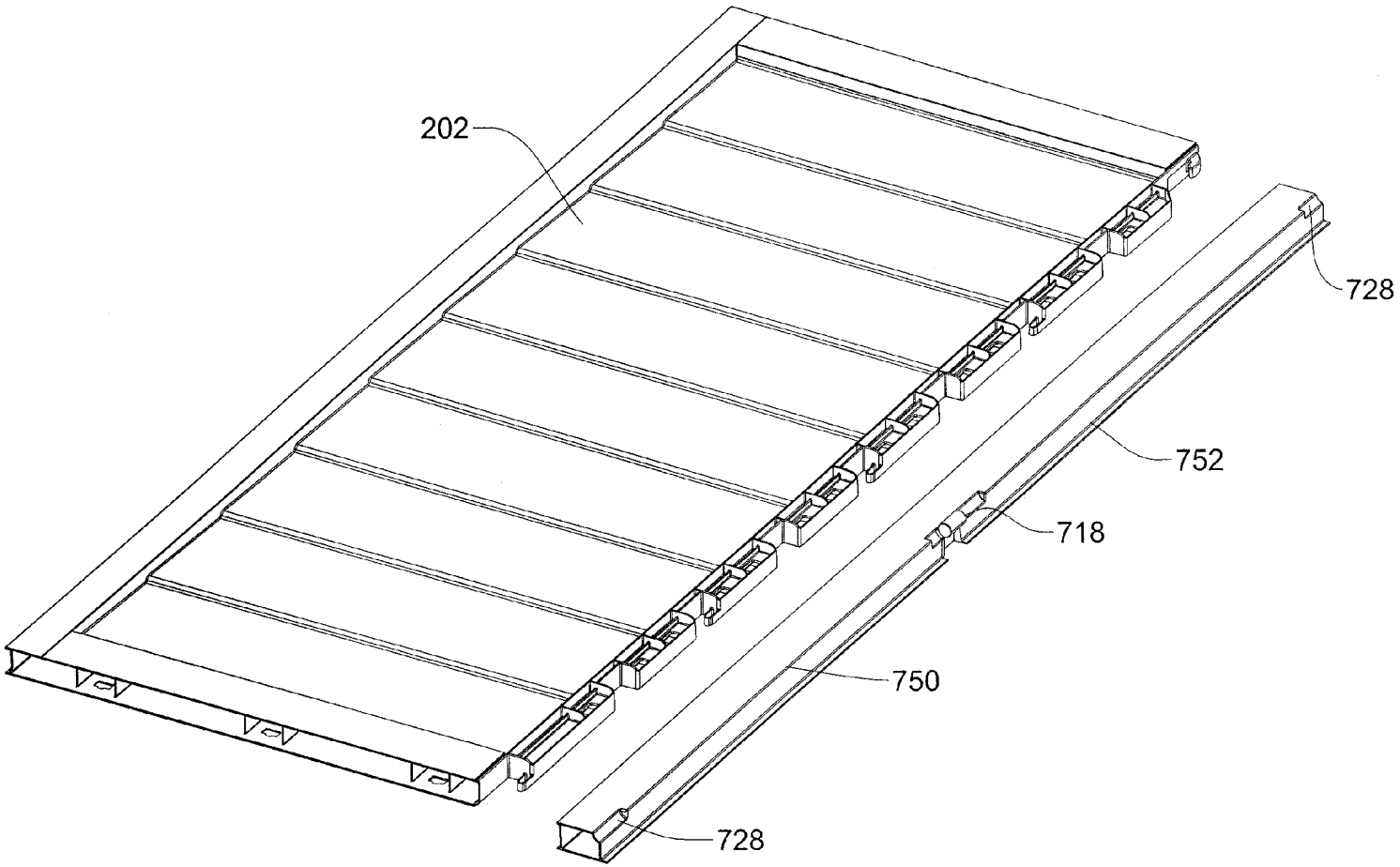
FIG. 20 is a perspective view illustrating assembly of the door frame member to a wall panel.

Referring to FIGS. 18-19, a wall panel reinforcement channel 701 is illustrated. The side wall reinforcement channel is generally C-shaped and includes a first end 740, a second end 742, an inner surface 746, and an outer surface 747. The inner surface includes a plurality of formed flexible hooks 748. Each flexible hook includes a barb 749. In operation the reinforcement channel is attached to the inner socket wall 316 of a pair of assembled wall panels 202 by inserting the flexible hooks through apertures 254 until the barbs 710 engage the inner surface of the socket 330. The reinforcement channels are preferably constructed of steel or other suitable metal and provide significant rigidity and weight carrying capacity to the wall assemblies. In addition, the reinforcement channels prevent the panels 202 from bowing or bending inwardly or outwardly, and thus, adversely affecting the appearance or operation of the enclosure 10. Still yet, the reinforced ribs provide support for optional cantilever shelves 800 (FIG. 45-46) or stackable shelves 900 (FIGS. 47-50) by distributing any load applied to the shelves across the length of the wall panels.

Figure 25:
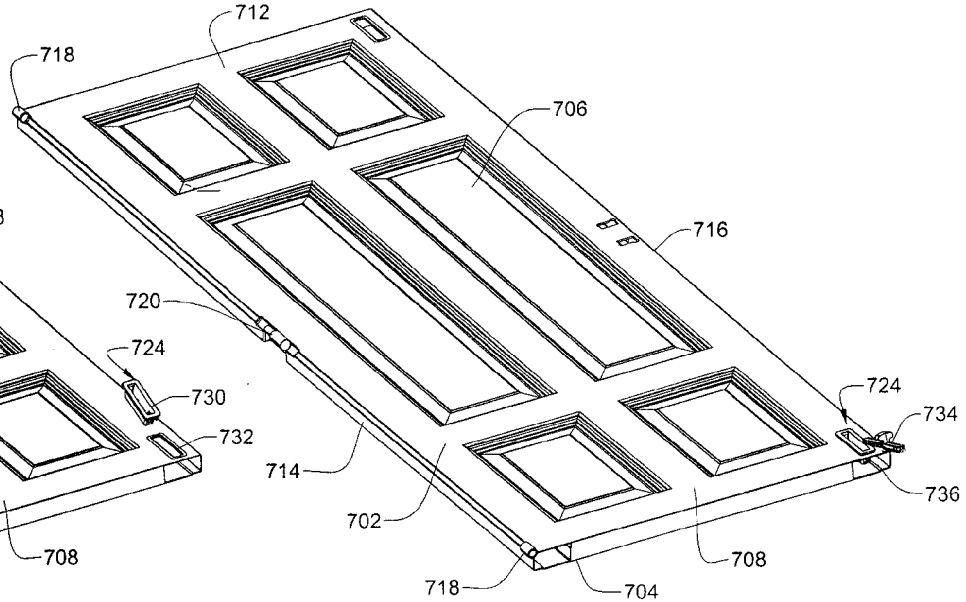
FIG. 25 is a perspective view illustrating one of the door panels utilized in the instant invention as well as assembly of a sliding door latch.
Figure 24:
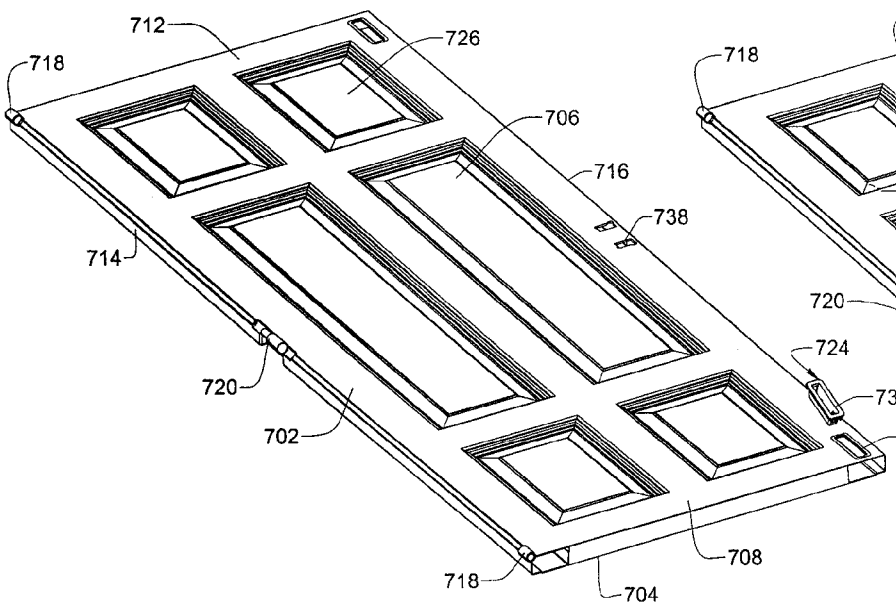
FIG. 24 is a perspective view illustrating one of the door panels utilized in the instant invention as well as assembly of a sliding door latch.

Referring to FIGS. 3, 24 and 25, the door assembly 700 is illustrated. The door assembly includes a pair of door panels 702, a pair of door frame members 750, a hinge means 720, a door handle assembly 726,728, and a latch assembly 724. The door panel 702 constitutes one of a plurality of like-configured panels in the system used to construct the door assembly. The door panels 702 are configured each having a first longitudinal end 708, a second longitudinal end 712, an inner surface 704, an outer surface 706, a first edge 714, and a second edge 716. To facilitate mechanical connection with door frame members 750 in a pivoting, relationship the first edge of the panels are provided with a pair of circular hinge conduits 718 and a hinge pin 720. The hinge conduits and hinge pin are constructed and arranged to cooperate with hinge pins and conduits integrally formed onto the door frame members 750 to allow pivoting movement of the door panel. The second horizontal edge 716 is constructed generally flat with the exception of an optional overlapping seal 722 (FIG. 3) extending the full length of the panel. The optional overlapping seal 722 may be attached by any suitable fastening means well known in the art or may be integrally formed with the panel. The door panels 702 are also provided with an upper and lower sliding latch mechanism 724 (FIGS. 24-25) as well as left and right door handles 726, 728 (FIG. 3).

Continuing with regard to FIGS. 3, 24 and 25, the outer surface 706 of the panels 702 are constructed generally smooth having a plurality of raised panels 726 for added strength and aesthetic appearance. The inside surface of the panel 704 is constructed with a plurality of raised panels 726 for added strength and aesthetic appearance. The raised panels 726 increase the structural integrity of the enclosure 10 by preventing the panels 702 from bowing or bending, inwardly or outwardly and thus, adversely affecting the appearance or operation of the enclosure 10.

Figure 26:
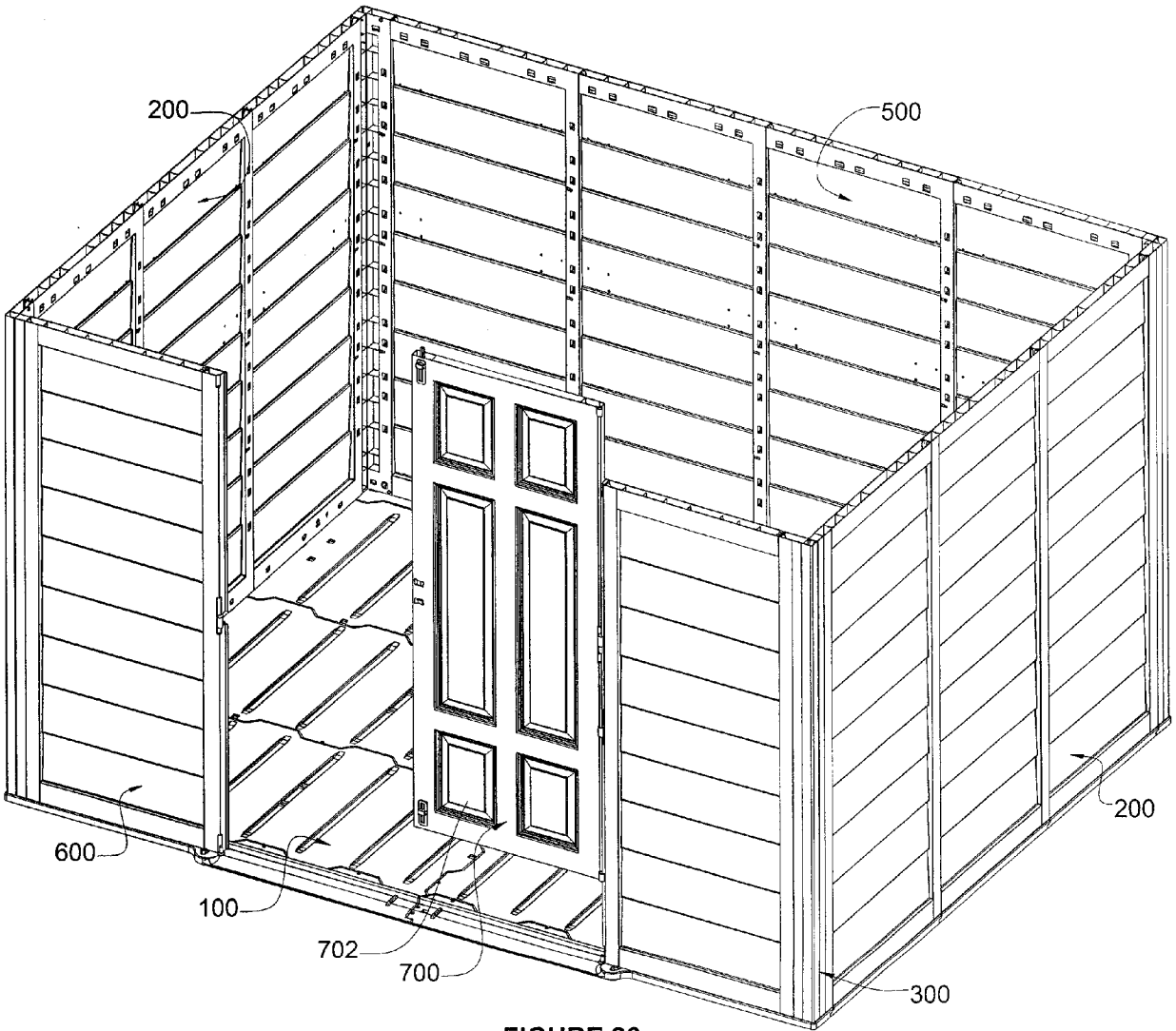
FIG. 26 is a perspective view illustrating assembly of a door panel to the assembled wall panels.
Figure 27:
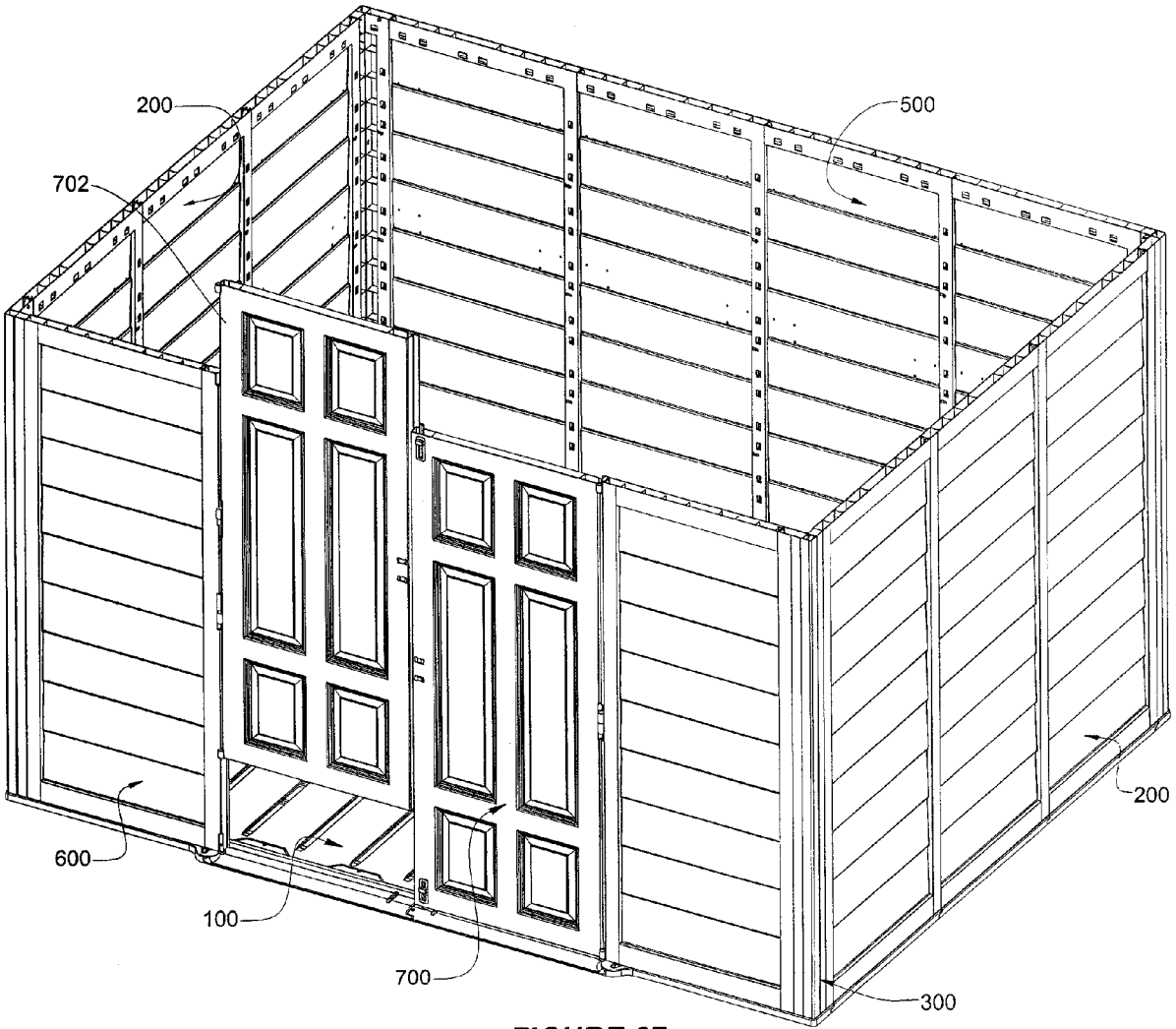
FIG. 27 is a perspective view illustrating assembly of a second door panel to the assembled wall panels.

Referring to FIGS. 26-27, the door panels 702 are attached to the interconnected floor panels 100, left and right corner post assemblies 300, and front wall assembly 600 by sliding the respective hinge pin 720 into the corresponding hinge conduits 718 located along the edge of the door frame 750 and the front end member of the floor assembly. Either door panel 702 is aligned with the hinge pins by sliding it vertically into place over the respective pins. It should be appreciated that this construction provides economic advantage allowing hinge components to be integrally formed onto the door panels. The door panels are also provided with removable and replaceable door latching mechanisms including slide latches 724, left door handle 726 and right door handle 728 (FIG. 3).

Referring to FIGS. 24-25, installation of the upper and lower slide latches 724 is illustrated. The slide latches are constructed and arranged to allow simple push-in installation. The latch housings 730 are merely pushed into apertures 732 located adjacent to edge 716 in the door panels 702 until the spring clips (not shown) engage an inner surface of the panel. Thereafter the one end of the door latch pin 734 is inserted through the housing 730 and downwardly until spring clip 736 is snapped into place. In this manner the door latches can be installed and removed as needed without the need for tools or screw type fasteners. By sliding the latch pin 734 to extend it outwardly to engage the roof assembly 400 or the floor assembly 100, the contents contained within the enclosure 10 are secured. The door handles 726, 728 are constructed and arranged to allow simple push-in installation. The handles are merely pushed into apertures 738 contained in door panels 702 until the spring clips (not shown) engage an inner surface of the panel 702. In this manner the door handles can be installed and removed as need without the need for tools or screw type fasteners. The handles are also provided with lock apertures allowing the contents contained within the enclosure to be secured with a padlock or the like.

Referring to FIGS. 28-32 the roof assembly 400 includes a pair of like constructed header assemblies 450. The header assembly is a truss like structure molded with an aesthetically pleasing generally smooth wall on its outer surface 452 and integrally formed box bracing 454 and a plurality of pockets 456 constructed and arranged to accept roof support beams on its inner surface 454. In the preferred embodiment the header is constructed of a center member 472 and a pair of outer members 474. This construction permits the center member to be exchanged for narrower or wider members to construct different sized enclosures while the outer members may remain the same. Each member of the header assembly includes an upper surface 458 and a lower surface 460. The lower surface 460 includes a third means of connection illustrated herein as a plurality of inwardly extending engagement sockets 462 constructed and arranged to cooperate with removable and replaceable bosses 464 and/or door hinge pins 466. The bosses 464 or hinge pins 466 are slid into their respective engagement sockets 462 until the integrally formed spring tabs 468 engage corresponding apertures 470 formed in the engagement sockets. The end surfaces 476, 478 of the members include a ninth means of connection illustrated herein as a plurality of outwardly extending inter-fitting tubes 480. The tubes are constructed and arranged to extend into an adjacently positioned header member until integrally formed spring locks engage. This construction provides a load distributing connection between the members that prevent separation and bowing of the assembly under load. In addition, the design provides a sealed connection between the panels preventing weather infiltration. The resultant header created by the combination of the interlocking members benefits from high structural integrity and reliable operation.

The front header is assembled to the floor and wall assemblies by sliding the hinge pins 466 into their respective hinge conduits 718 while simultaneously sliding the locking bosses 464 into the wall sockets 210 until the integrally formed spring clips engage the apertures 234 formed into the wall panels. The result is a positive lock that maintains alignment of the panels in the same plane and prevents bowing or bending of either panel relative to one another.

Figure 28:
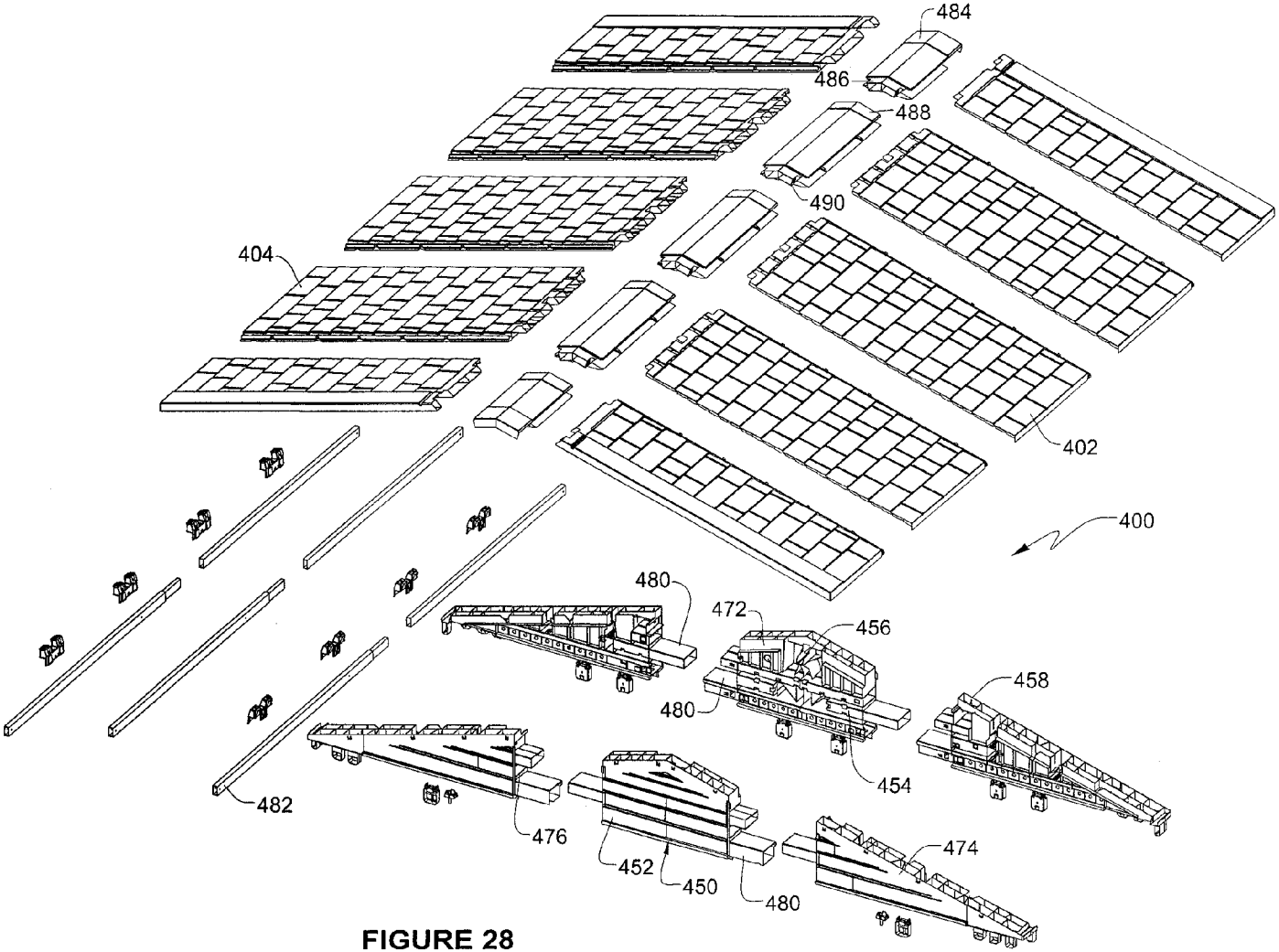
FIG. 28 is an exploded view of the roof assembly as utilized in the instant invention.
Figure 29:
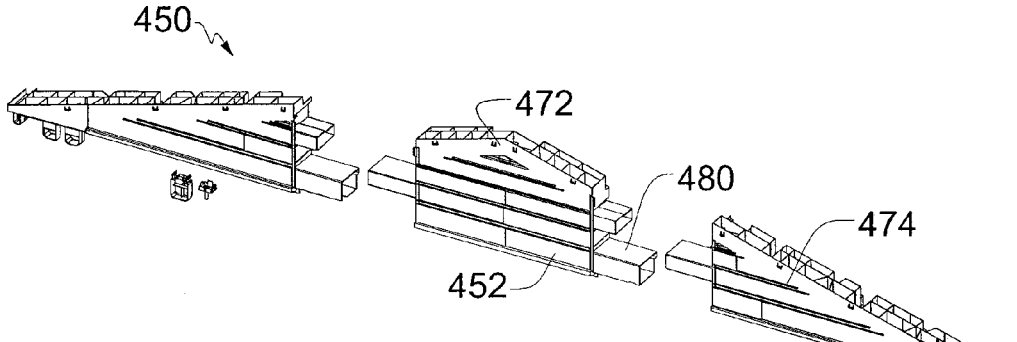
FIG. 29 is a front perspective exploded view of a header assembly as utilized in the instant invention.
Figure 30:
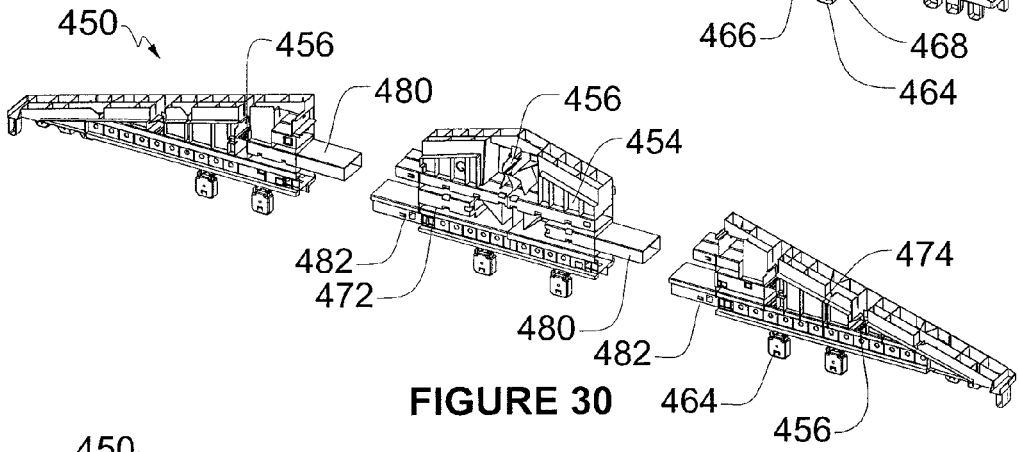
FIG. 30 is a rear perspective exploded view of a header assembly as utilized in the instant invention.
Figure 31:
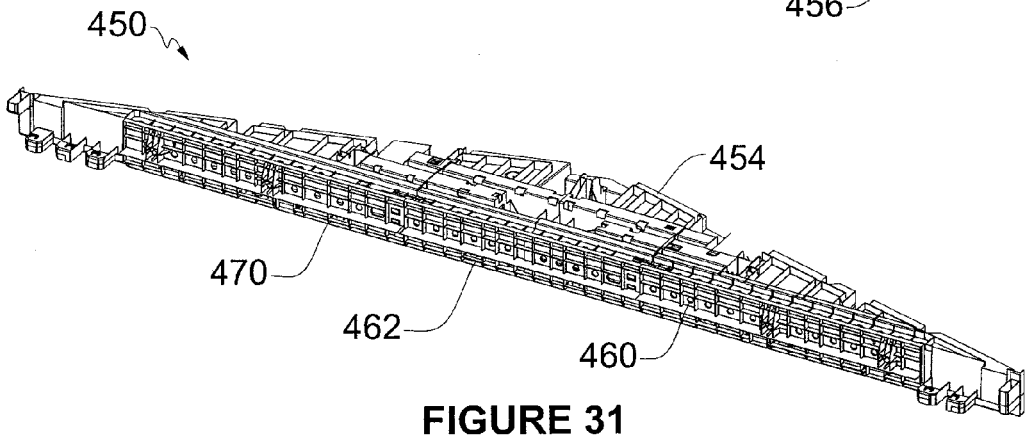
FIG. 31 is a rear perspective view of a header assembly as utilized in the instant invention.
Figure 32:
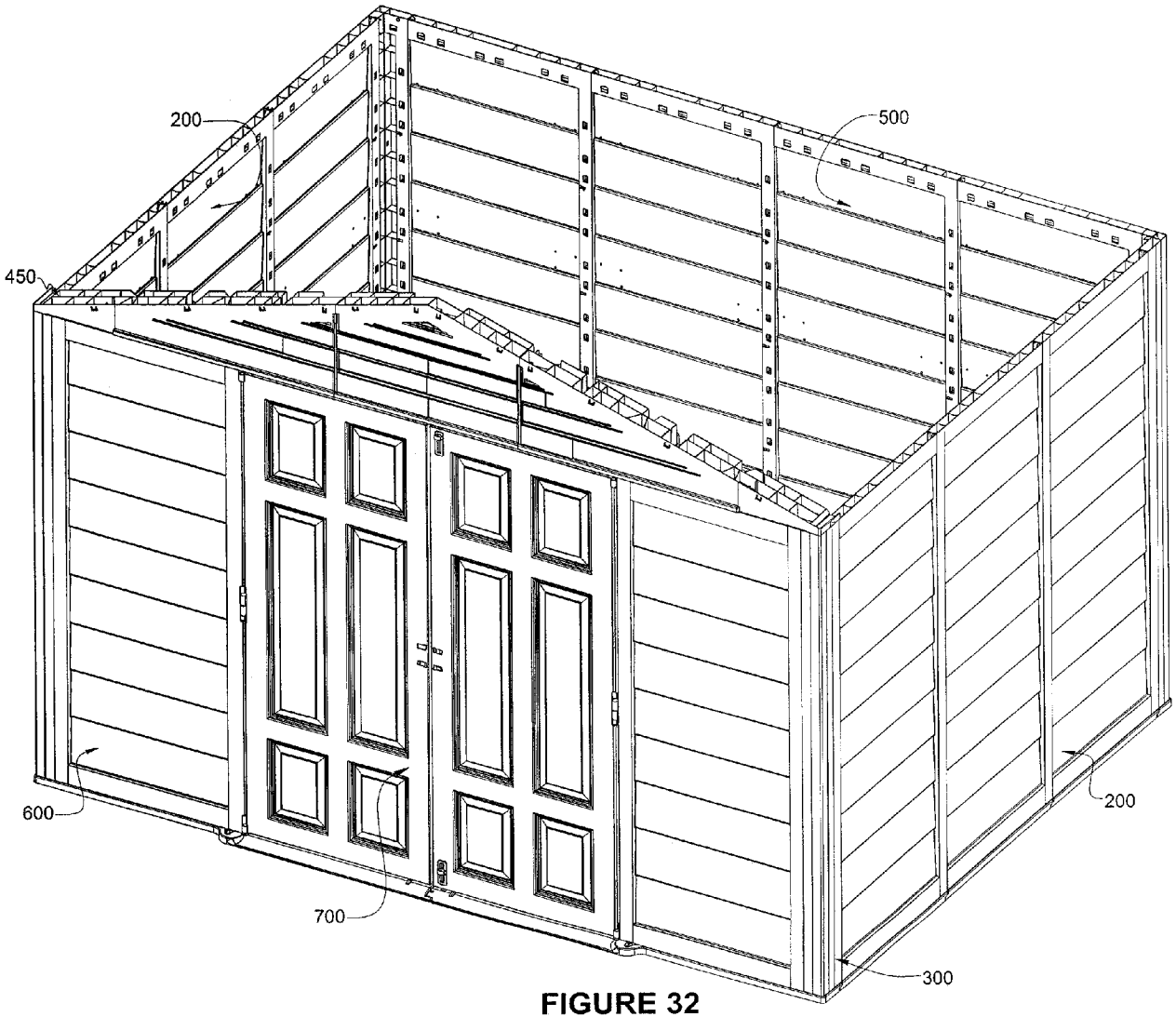
FIG. 32 is a front perspective view of a header assembly secured to the front wall assembly and corner posts.
Figure 33:
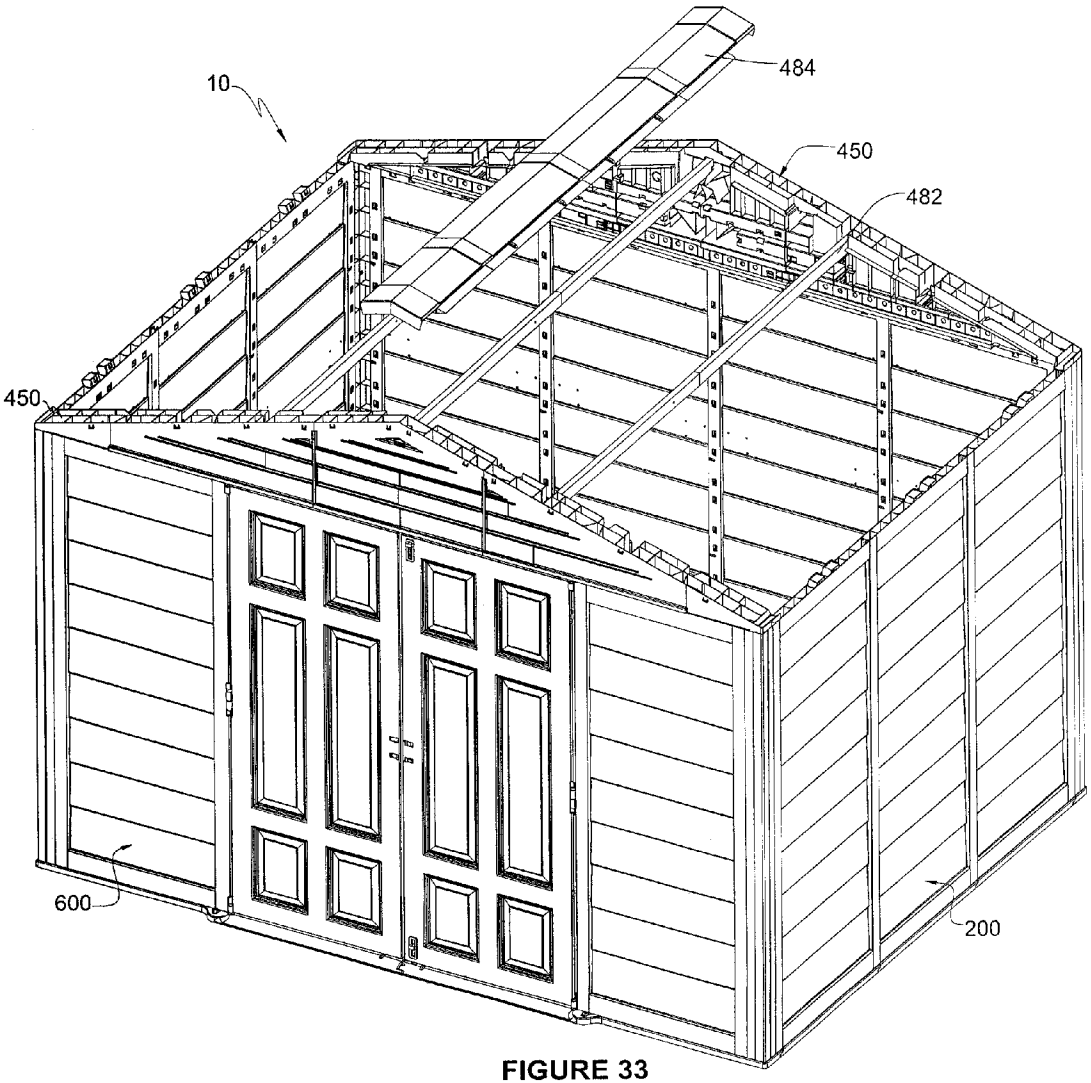
FIG. 33 is a perspective view illustrating the assembly of the roof header and roof support beams.
Figure 34:
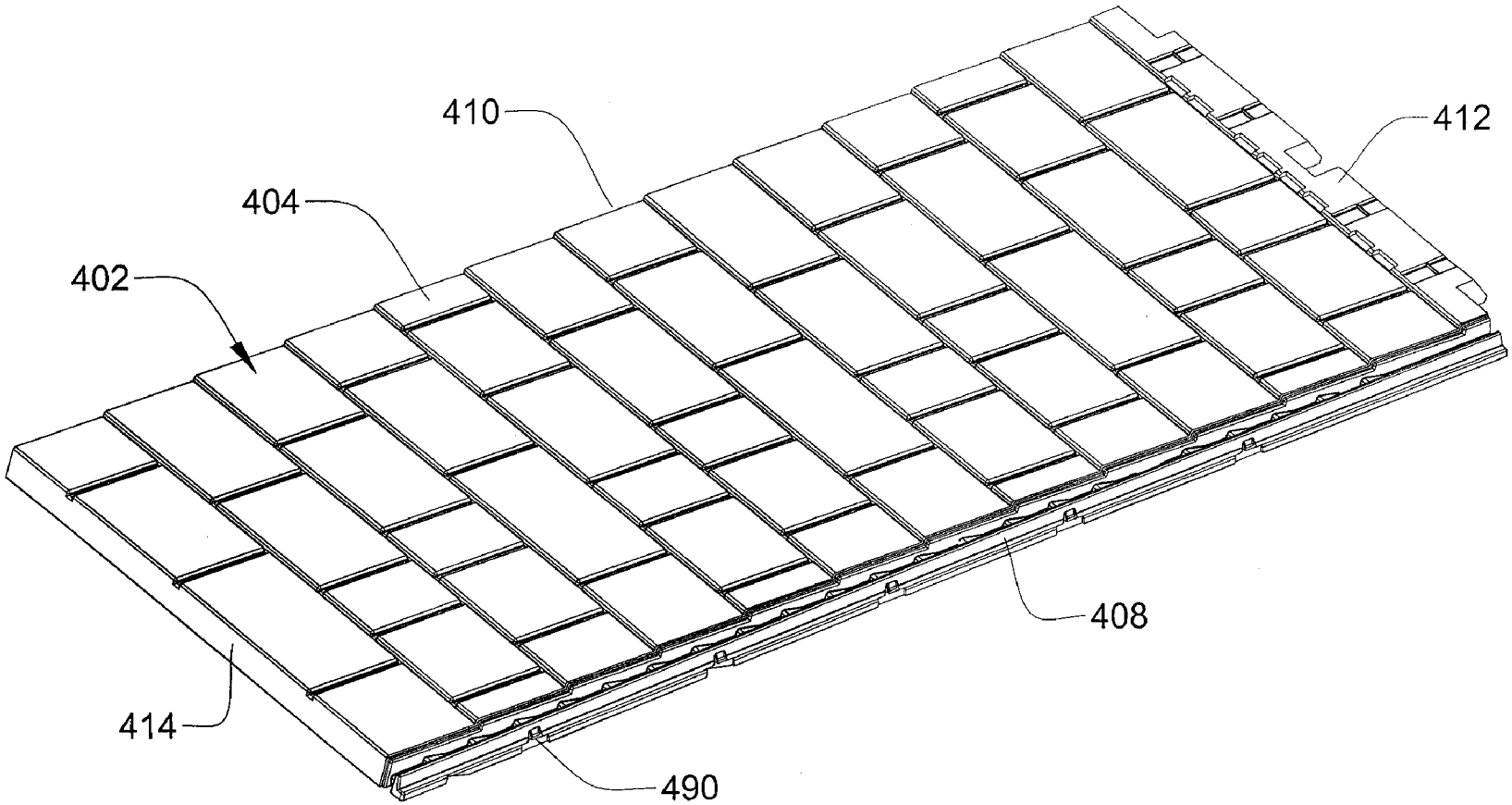
FIG. 34 is a perspective view illustrating a roof panel as utilized in the instant invention.
Figures 35A, 35B:
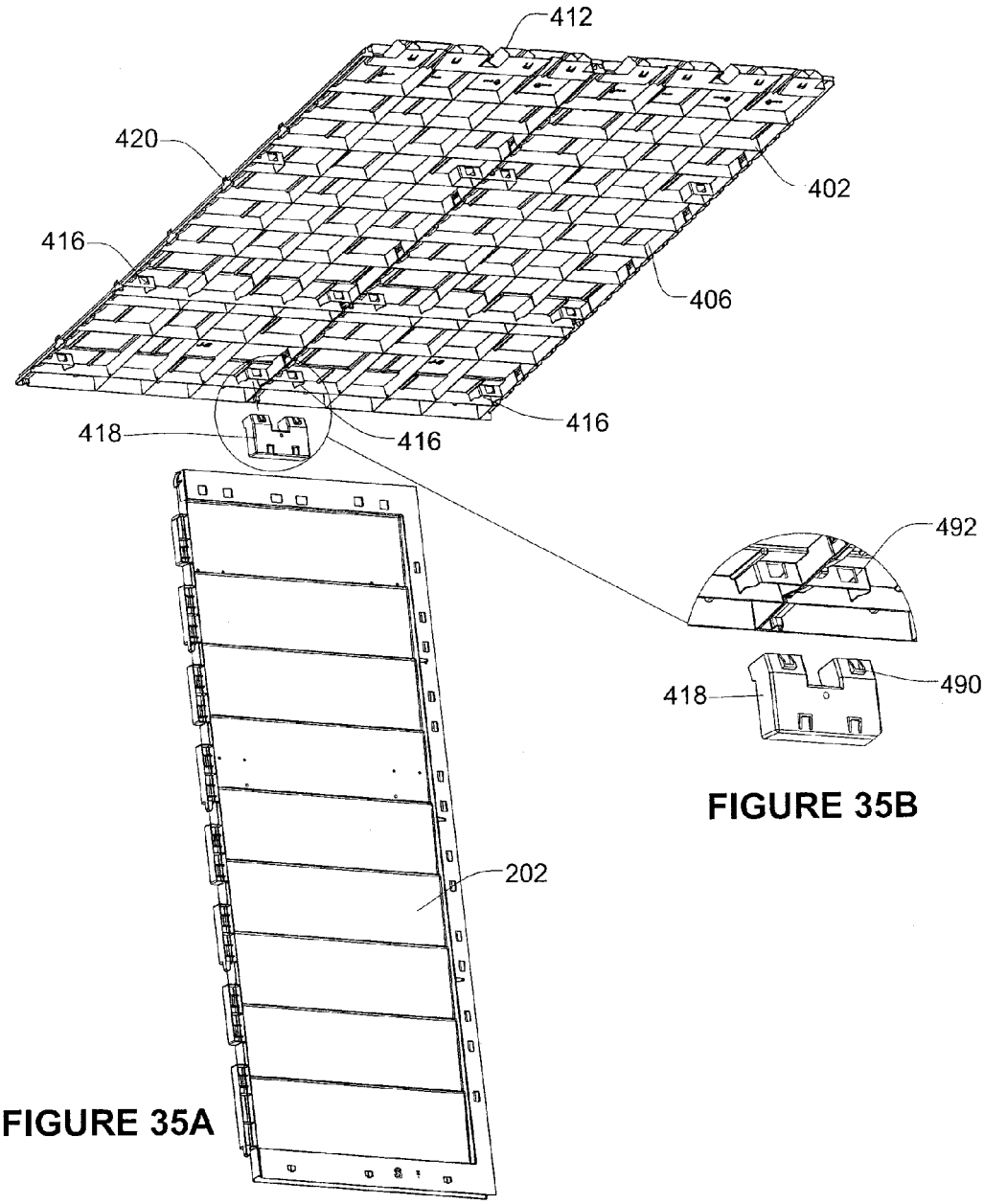
FIG. 35A is a partial perspective view illustrating the connection between the roof and wall panels.
FIG. 35B is a partial perspective view illustrating assembly of a connector boss to a roof panel.
Figures 36A, 36B:
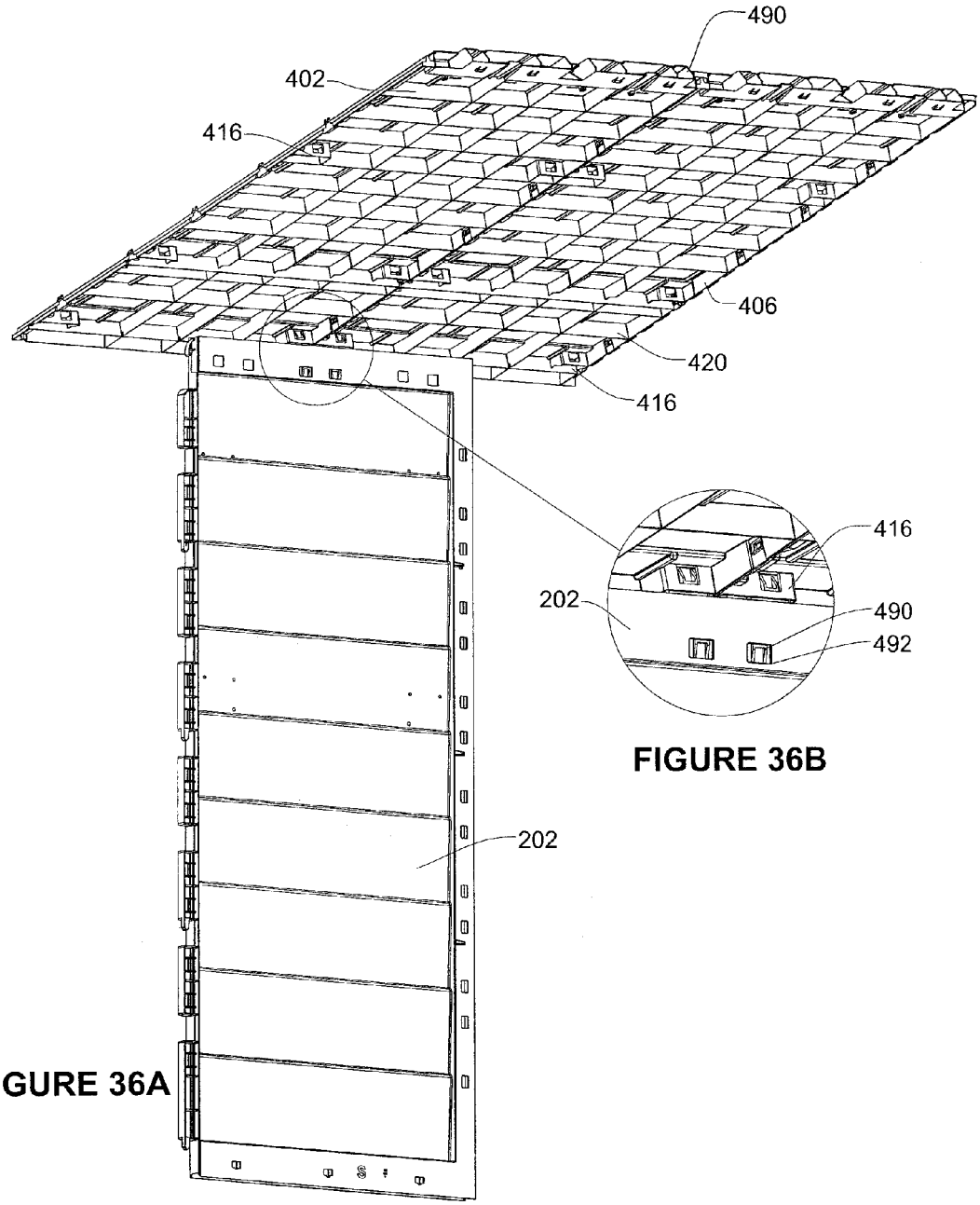
FIG. 36A is a partial perspective view illustrating the assembled connection of a wall panel and a pair of roof panels.
FIG. 36B is a partial perspective view illustrating the assembled connection of a wall panel and a pair of roof panels.
Figures 37A, 37B:
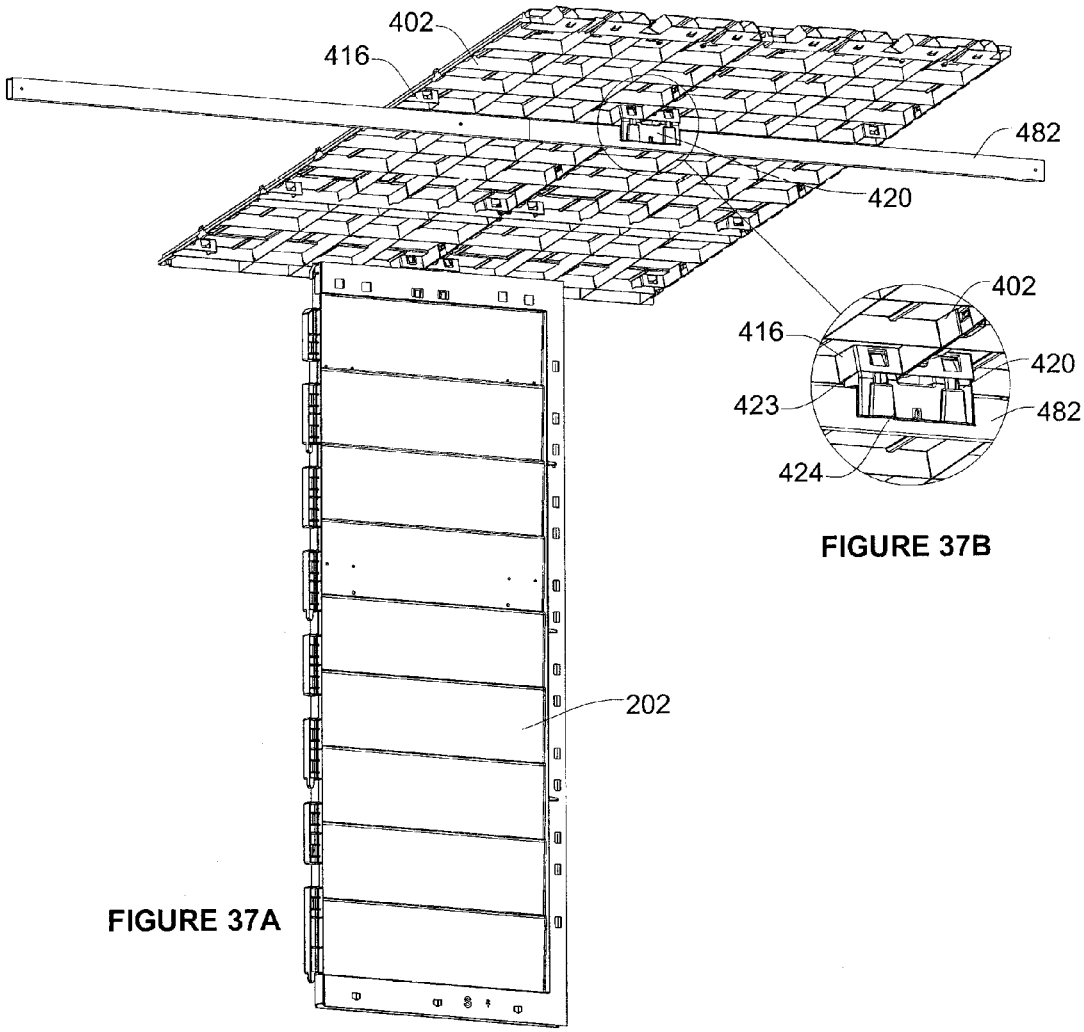
FIG. 37A is a partial perspective view illustrating assembly of a connector boss to a roof support.
FIG. 37B is a partial perspective view illustrating a connected roof panel and roof support.
Figures 38A, 38B:
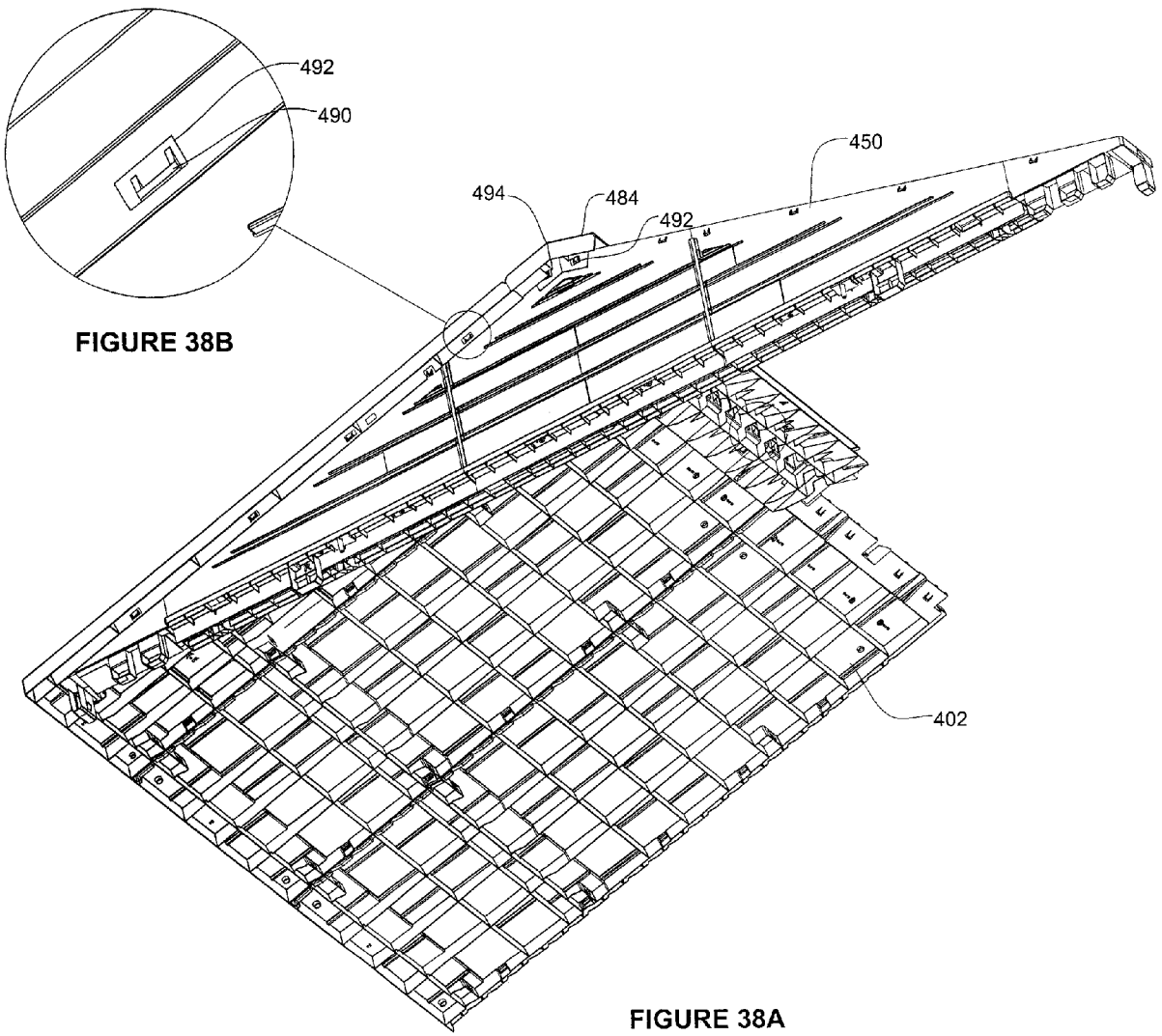
FIG. 38A is a partial perspective view illustrating a roof panel connected to the front header assembly and the ridge cap.
FIG. 38B is a partial perspective view illustrating a ramp-lock as utilized in the instant invention.
Figure 39B:
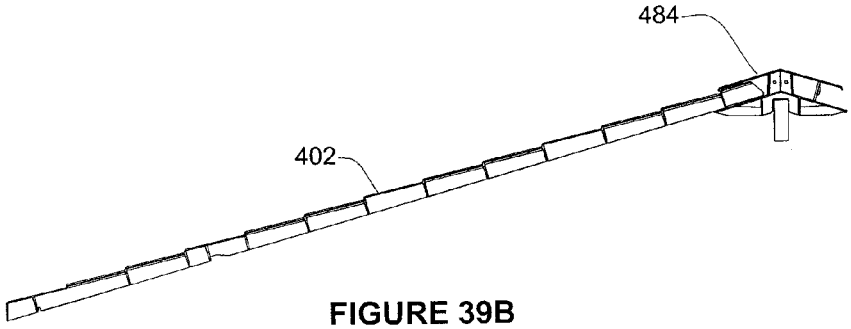
FIG. 39B is a section view taken along line 5-5 of FIG. 39A.
Figure 39A:
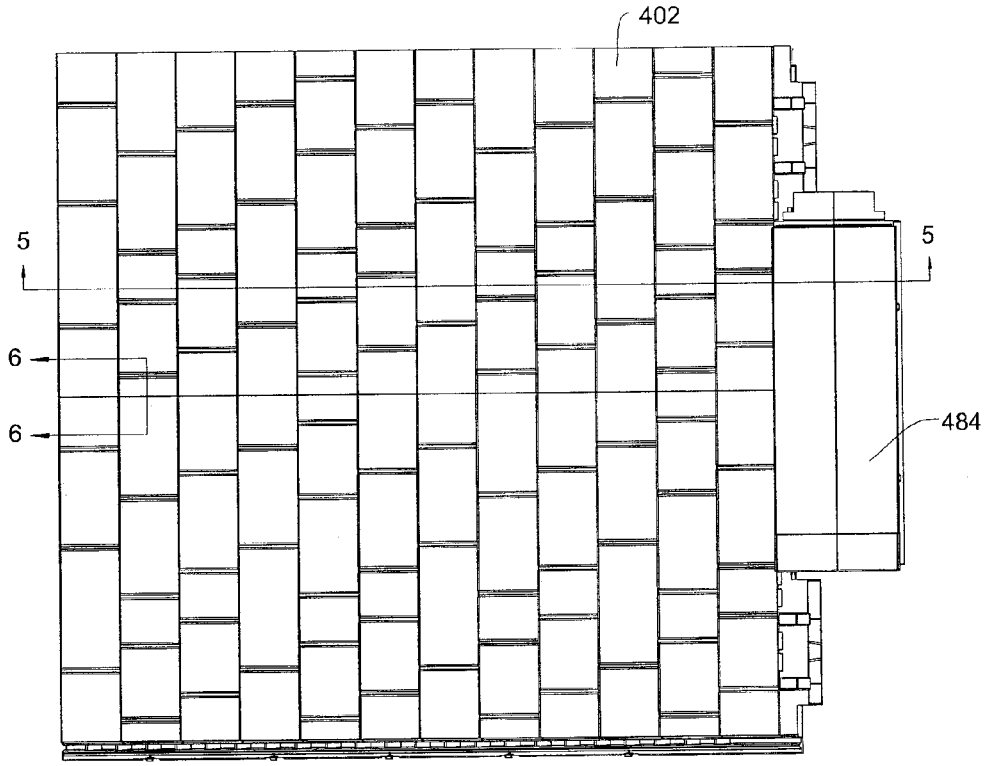
FIG. 39A is a partial top view of roof panels assembled to a header member.
Figure 39C:
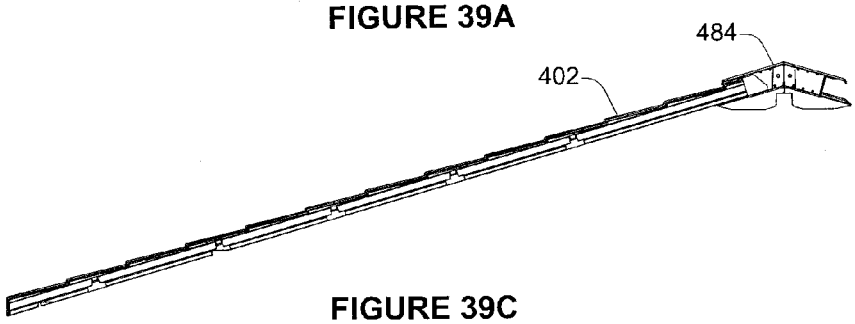
FIG. 39C is a rear view of the partial view shown in FIG. 39A.

Referring to FIGS. 28, 33, at least three and up to five roof supports 482 are inserted into their respective pockets 456 in each of the headers and secured in place with suitable fasteners. The support beams 482 are preferably constructed of steel, but may be constructed of other materials well known in the art capable of providing structural support to the roof assembly; such materials may include but should not be limited to plastic and/or wood as well as suitable combinations thereof. FIG. 33 is shown with a portion of the enclosure omitted for clarity, illustrating the placement of the support beams 482 in the preferred embodiment. The roof assembly 400 also includes a plurality of like constructed ridge cap members 484 and a plurality of like-constructed roof panels 402. Each ridge cap member 484 includes a tenth means of connection illustrated herein as at least one outwardly extending boss 486 and at least one socket 488 for securing the ridge cap members together. The ridge cap members 484 are slid together until the ramp-locks 490 integrally formed into the bosses 486 engage corresponding apertures (not shown) formed in the sockets 488. The assembled ridge cap is slid into place over the headers and fastened in cooperative engagement with the support beams 482 and the headers 450. Ramp-locks 490 (FIG. 38B) integrally formed into the front surface 452 of the headers 450 cooperates with apertures 492 formed into a front depending wall 494 (FIG. 38A) to secure the ridge cap assembly in place. As the ridge caps are pushed into place over the header the depending wall is deflected by the ramp-lock until the aperture 492 snaps over the ramp-lock to secure the ridge cap assembly in place.

Figure 40:
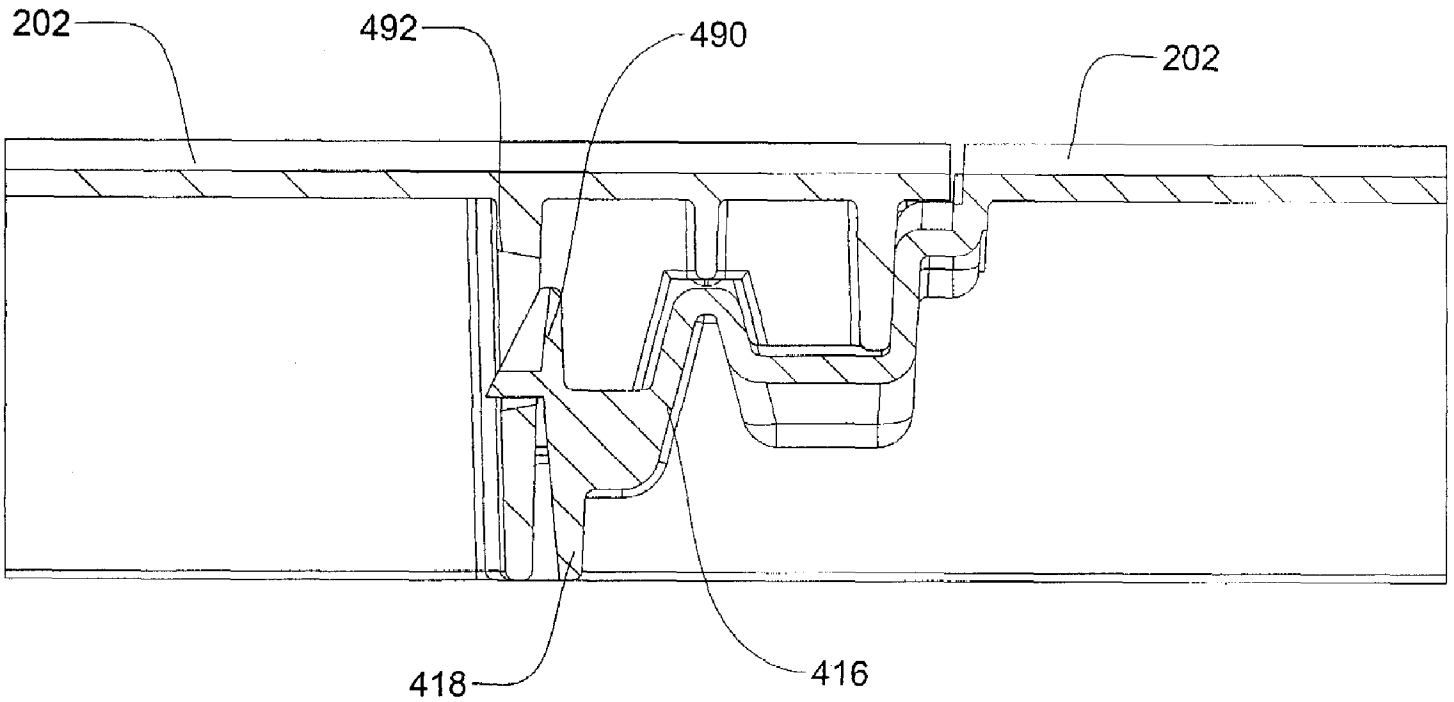
FIG. 40 is a section view taken along line 6-6 of FIG. 39A illustrating the overlapping connection between the roof panels.
Figure 41:
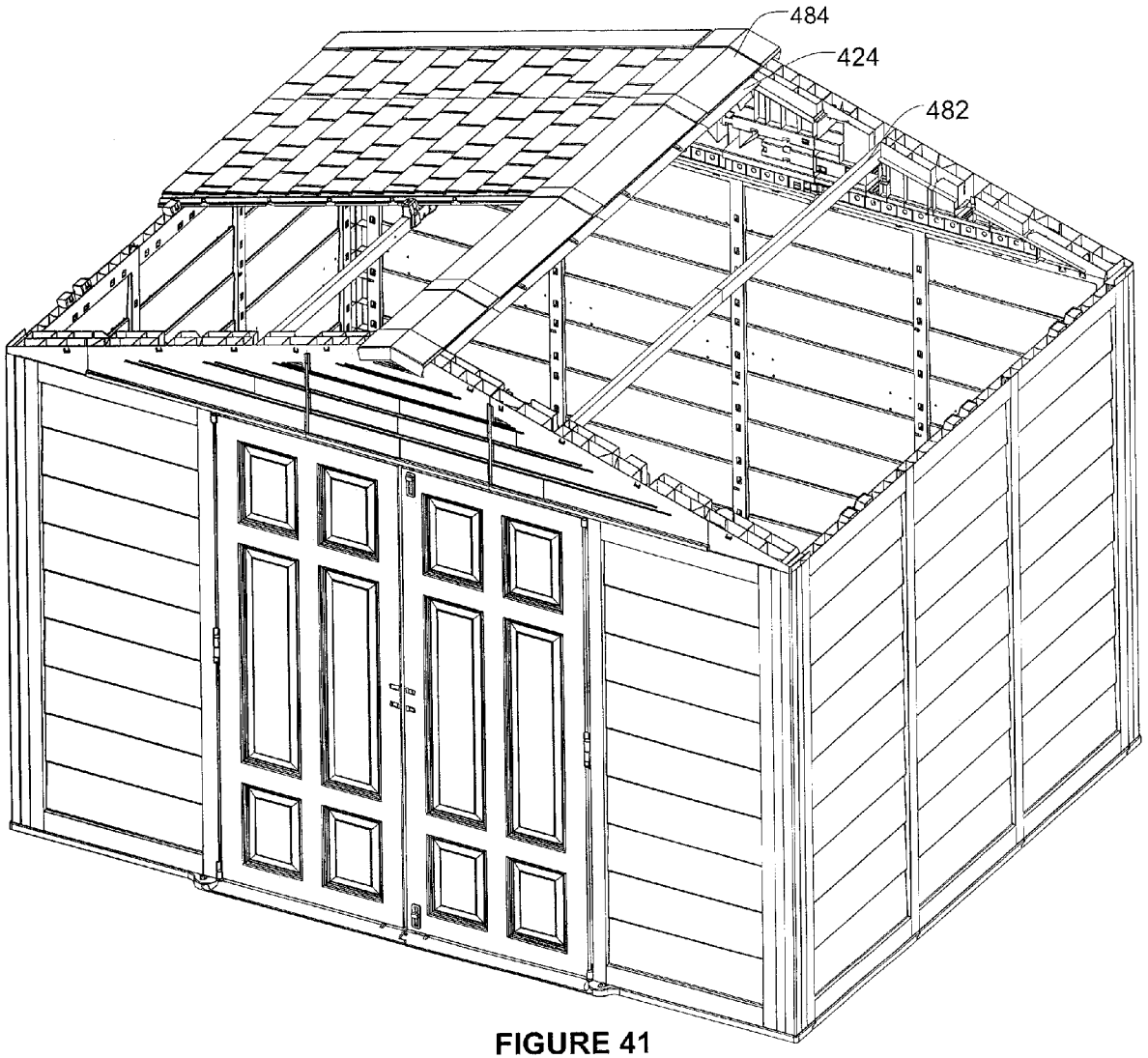
FIG. 41 is a partial perspective view illustrating assembly of roof panels to the assembled ridge cap, headers and roof supports.

Referring to FIGS. 28-41, each roof panel has a top surface 404, bottom surface 406, a first locking edge 408, a second locking edge 410, a third locking edge 412 and a closed edge 414. Along the bottom surface 406 adjacent to the closed edge 412 is a fifteenth means of connection illustrated herein as a plurality of sockets 416 constructed and arranged to receive roof connectors 418. The roof connectors are constructed and arranged to cooperate with pockets 210 located at second longitudinal end 212 of the structural wall panels 202 as well as the sockets 416 located on the lower surface 406 of the roof panels 402. A series of spaced apart structural ribs 420 extend across the lower surface of each roof panel 402 to provide increased weight carrying capacity to the roof assembly 400. The first and second locking edges of the roof panel 402 include a thirteenth and fourteenth means of connection illustrated herein as a W-shaped overlapping connection 416 (FIG. 40). The distal portion 418 of the first edge overlapping connection including a plurality of ramp-locks 490 arranged to cooperate with apertures 492 formed into the second edge overlapping connection. The W-shaped overlapping connection provides a water resistant seal between the panels and prevents the panels from bowing or separating under wind or snow loads. The third locking edge 408 of each roof panel 402 includes a twelfth means of connection illustrated herein as an interlocking tube 422 constructed and arranged to cooperate with a ridge cap 484 having a conjugately shaped receiver 424 (FIG. 41) to create a weather resistant seal. The roof panels 402 are slid into the receiver 424 until the integrally formed ramp-locks 490 engage corresponding apertures formed in the ridge cap 484. For interlocking cooperation between the roof panels 402 and the roof supports 482 a sixteenth means of connection is provided. The sixteenth means of connection is illustrated herein as a second roof connector 420. The second roof connector includes a first boss end 423 constructed and arranged to cooperate with sockets 416 and a second end 424 constructed and arranged to cooperate with the roof supports 482. For installation, the third edge of each roof panel is secured to the ridge cap and the closed edge is pivoted downward to engage the first and second roof connectors.

Figure 44:
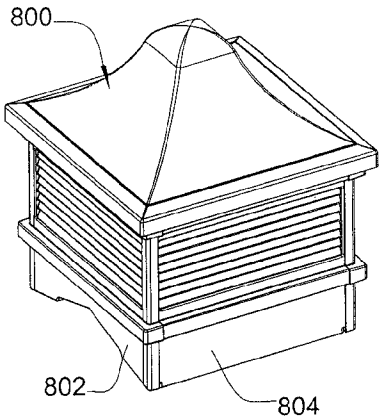
FIG. 44 is an assembled view of the cupola as utilized in the instant invention.
Figure 43:
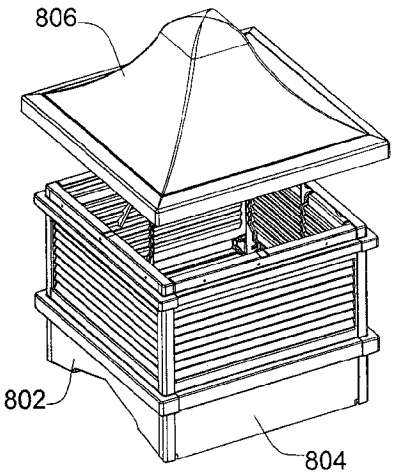
FIG. 43 is a partially exploded view illustrating assembly of the cupola top member.
Figure 42:
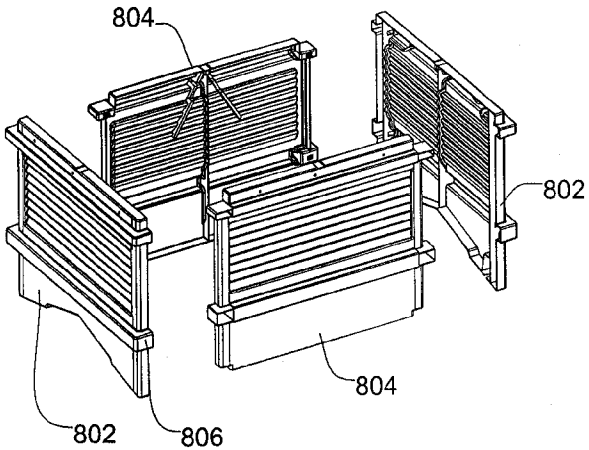
FIG. 42 is a partial exploded view illustrating assembly of the cupola walls.

Referring to FIGS. 42-44 a cupola 800 is illustrated. The cupola includes a pair of side walls 802 and a front and rear wall 804. The cupola is generally constructed and arranged for shipment in a disassembled state and may thereafter be assembled at a desired site. The edges of the side panels are preferably constructed to receive the edges of the front and rear panels in an interlocking relationship. Thereafter the top panel may be assembled to the side walls to finish assembly of the cupola. In one embodiment the lower portion of the cupola side walls are contoured to fit over the ridge cap of the instant embodiment. The cupola may be secured to the enclosure by any suitable means which may include fasteners, spring locks, ramp-locks or suitable combinations thereof.

Figure 45:
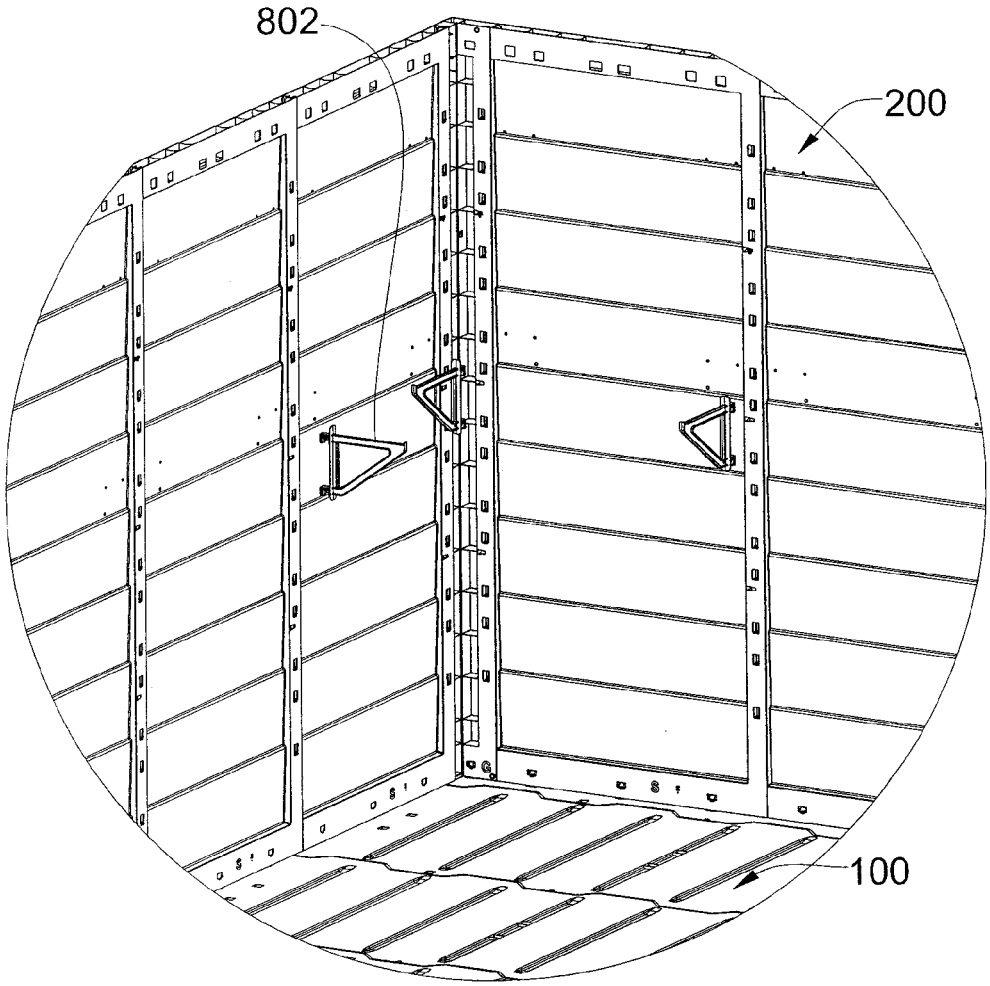
FIG. 45 is a partial perspective illustrating installation of a cantilever shelf embodiment securable to the inner surface of the wall panels.
Figure 46:
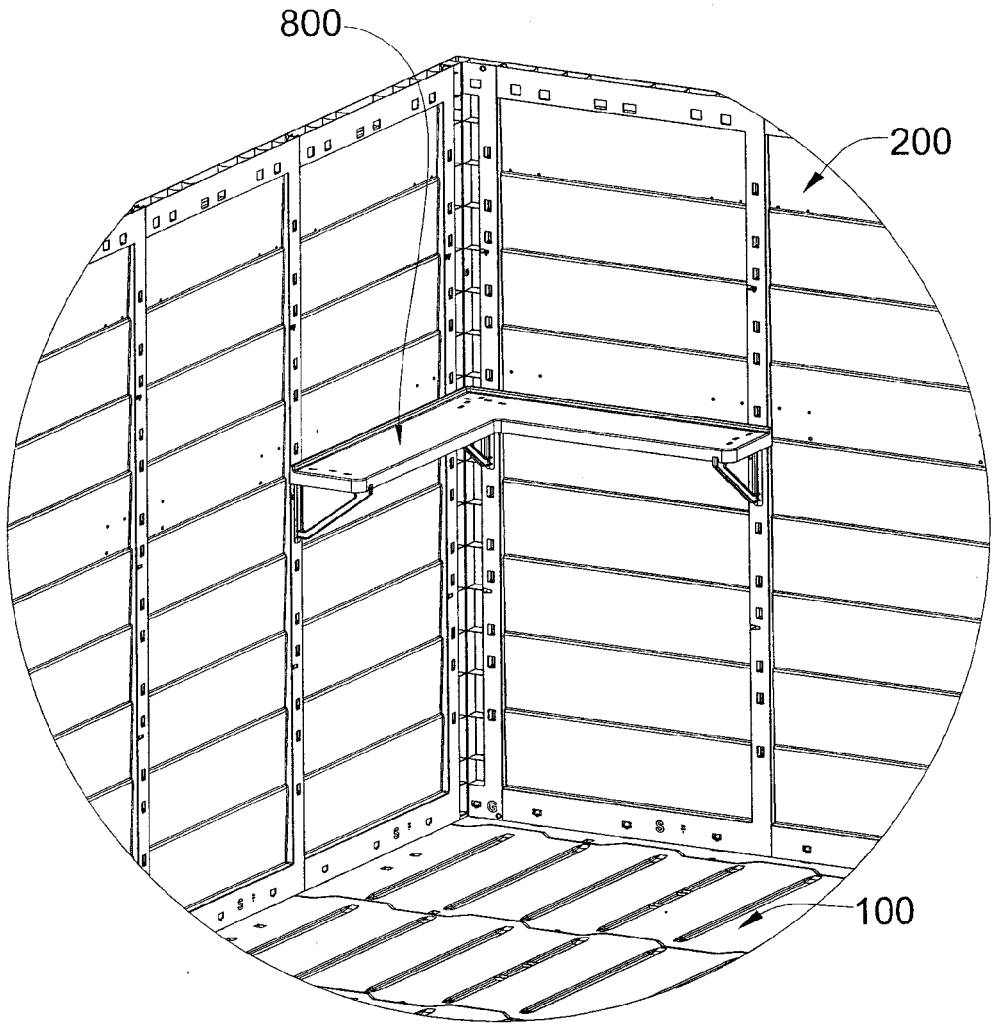
FIG. 46 is a partial perspective view illustrating an assembled cantilever shelf embodiment secured to the inner surface of the wall assemblies.
Figure 47:
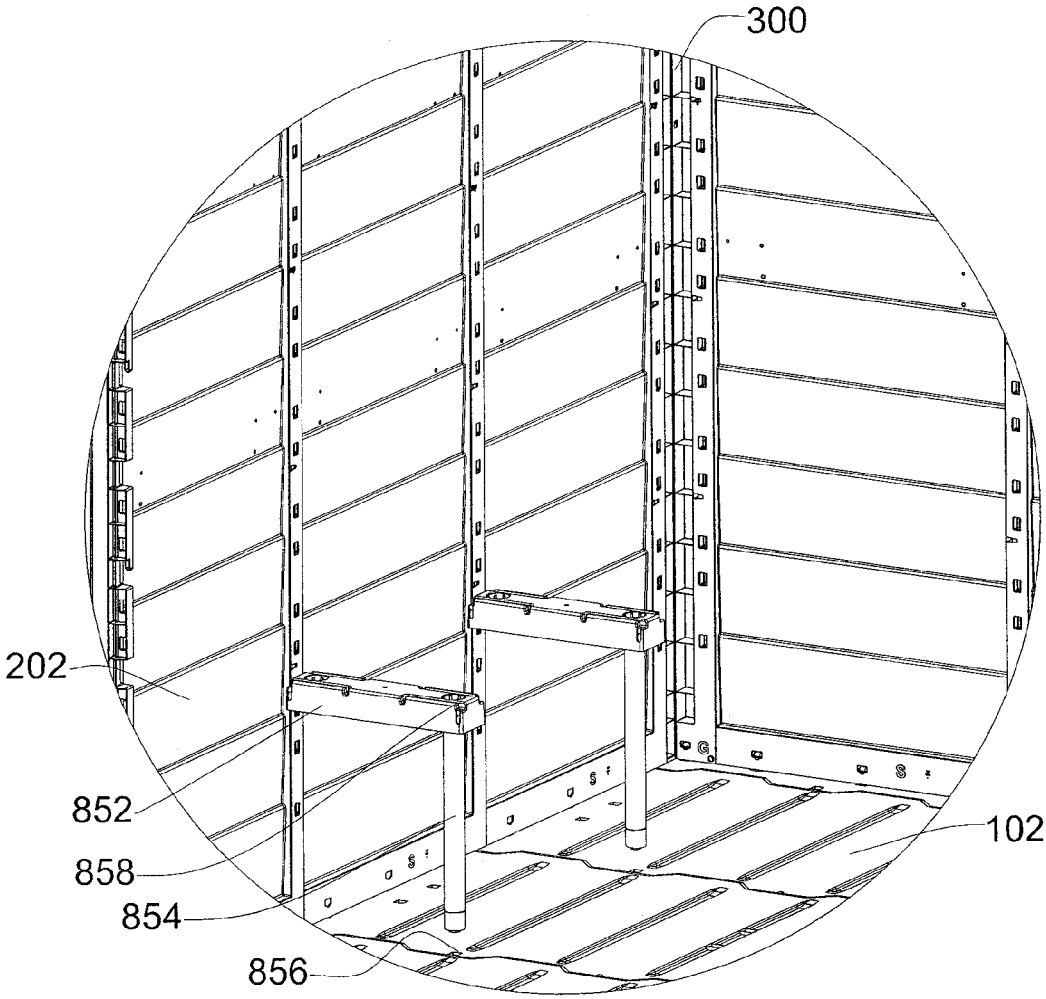
FIG. 47 is a partial perspective view illustrating assembly of a stackable shelf arrangement securable to the inner surface of a wall assembly.
Figure 48:
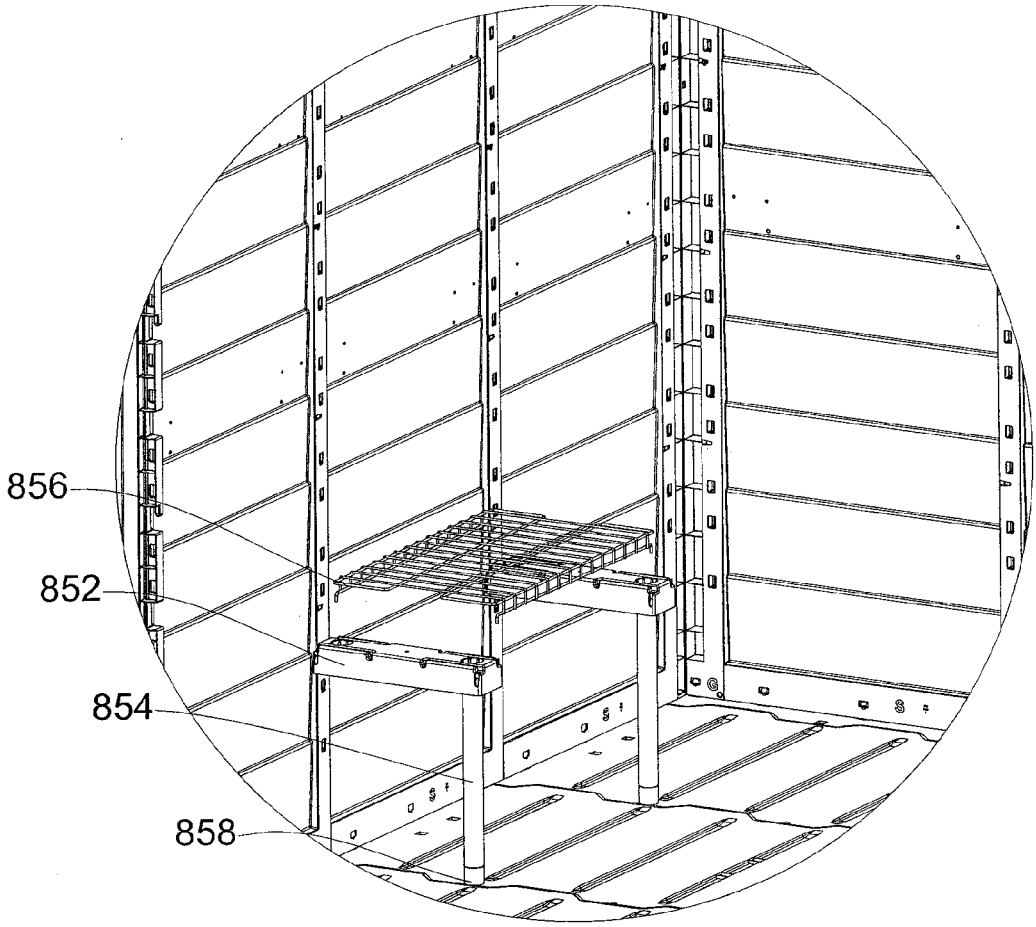
FIG. 48 is a partial perspective view illustrating assembly of a stackable shelf arrangement securable to the inner surface of a wall assembly.
Figure 49:
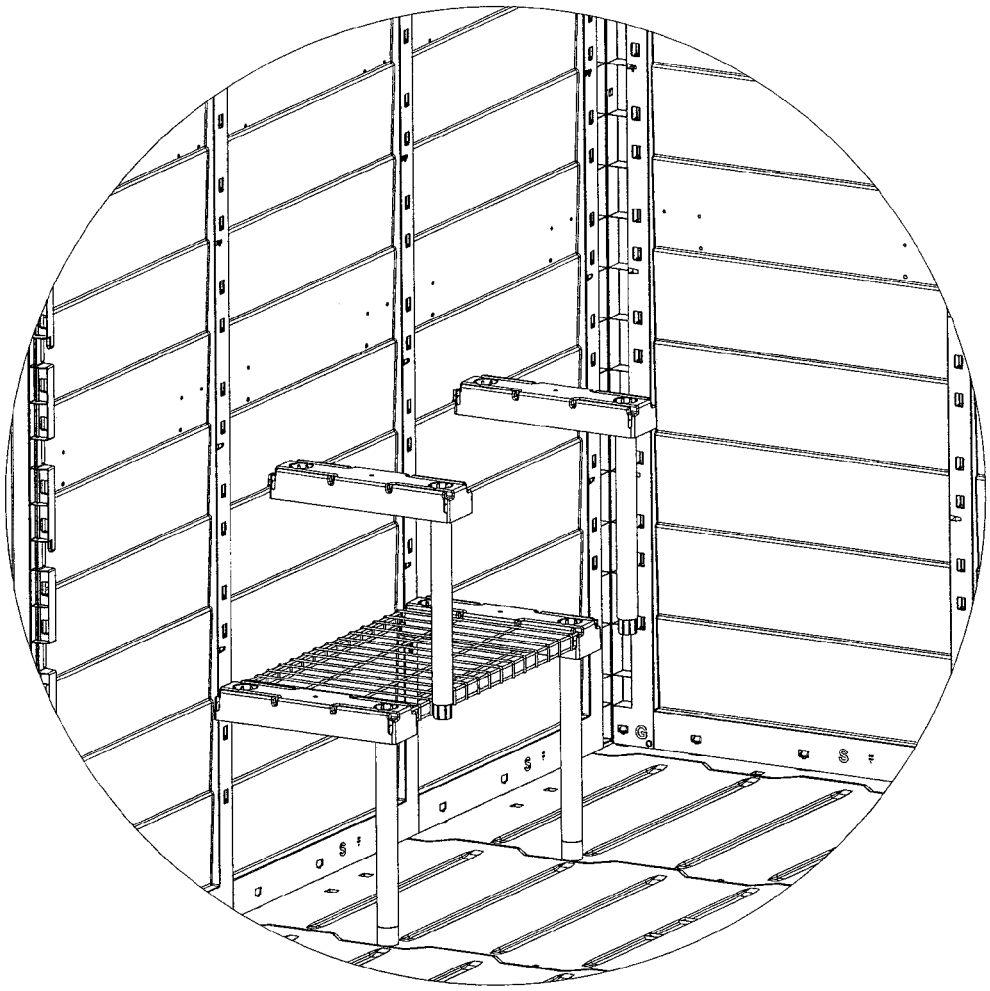
FIG. 49 is a partial perspective view illustrating assembly of a stackable shelf arrangement securable to the inner surface of a wall assembly.
Figure 50:
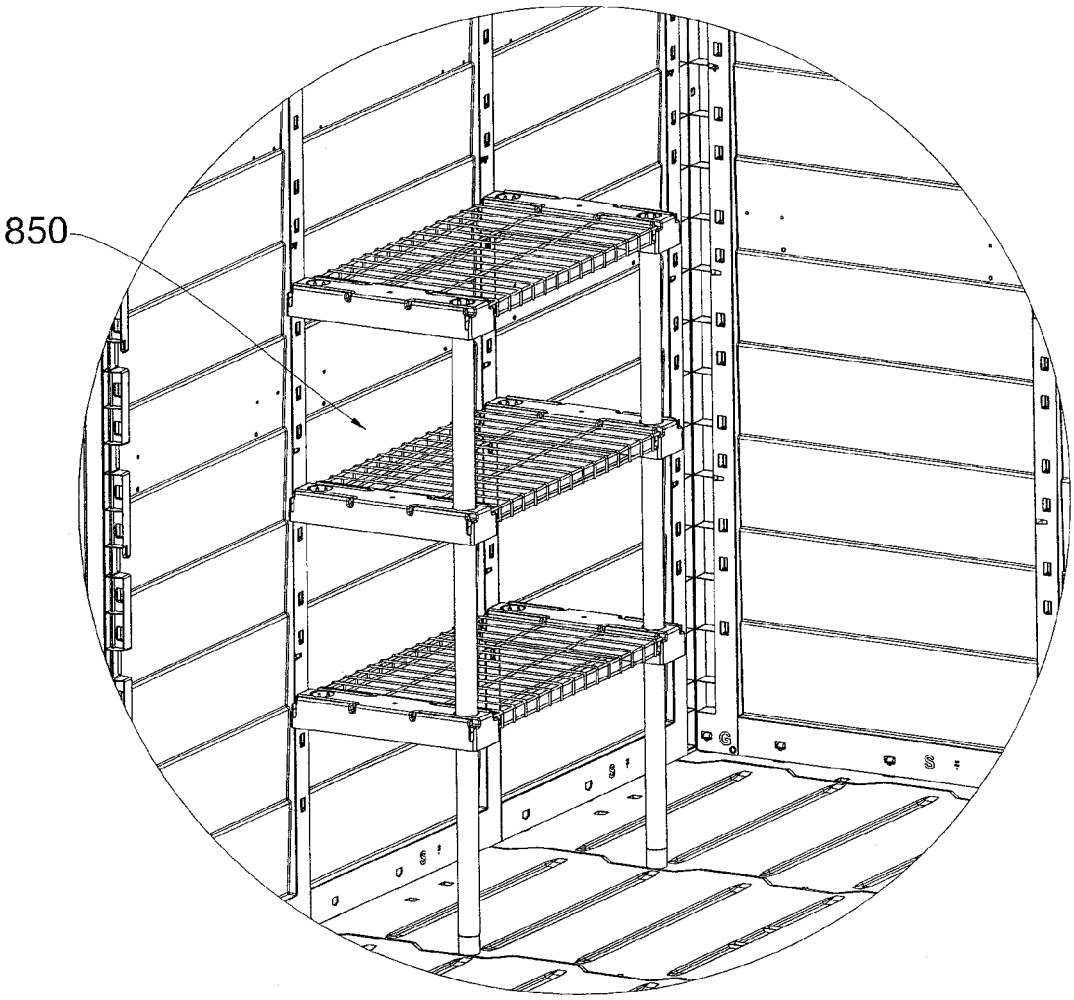
FIG. 50 is a partial perspective view illustrating an assembled stackable shelf arrangement secured to the inner surface of a wall assembly.

Referring to FIGS. 45-46 installation and assembled views of cantilever type modular shelving 800 are illustrated. The cantilever shelving includes cantilever wall mounts 802 constructed and arranged to cooperate with wall panels 202 for snap-in engagement. The cantilever shelf 804 is constructed and arranged to snap into engagement with the wall mounts. This arrangement permits assembly without the need for fasteners. The plurality of apertures 254 formed into the inner surface of the wall panels permits the shelving to be mounted in various predetermined positions within the enclosure to suit a user's needs.

FIGS. 47-50 illustrate assembly of stackable shelving 850. The stackable shelving includes at least two horizontal members 852, at least two vertical members 854, and a shelf member 856. The horizontal members are constructed and arranged to cooperate with aperture 254 formed into the inner surface of the wall panels at a first end and the vertical members 854 at a second end. The bottom portion of the vertical members include an integrally formed projection for interlocking cooperation with an indentation 856 (FIG. 47) formed into the upper surface of the floor panels 102. Additional shelves may be added to the assembly in a vertical manner by engaging additional vertical members into sockets 858 formed into the upper surface of the horizontal member 852 and thereafter assembling additional horizontal members thereto.

Figure 51:
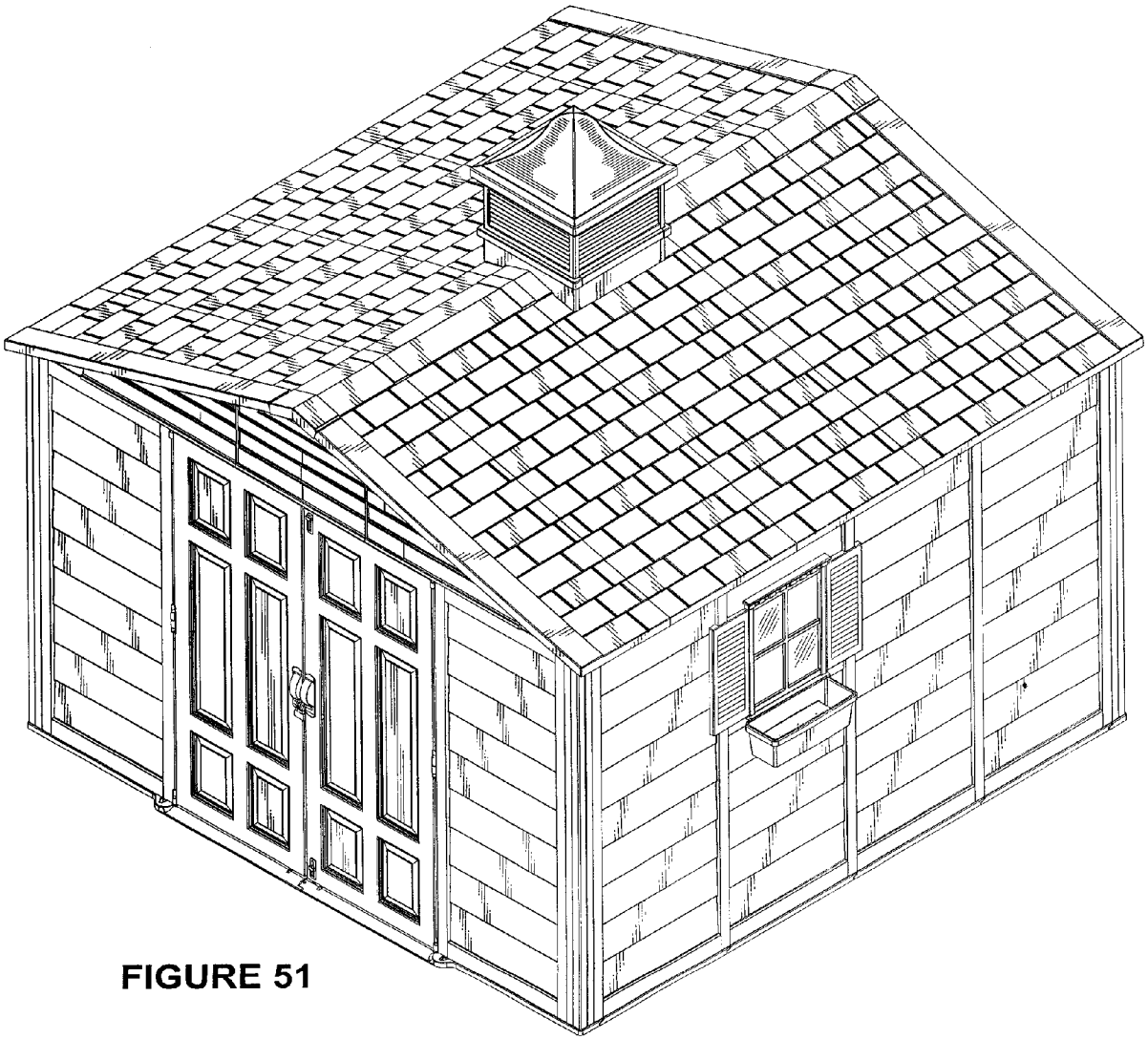
FIG. 51 is a front perspective view illustrating a larger utility enclosure constructed with the teachings of the instant invention.
Figure 52:
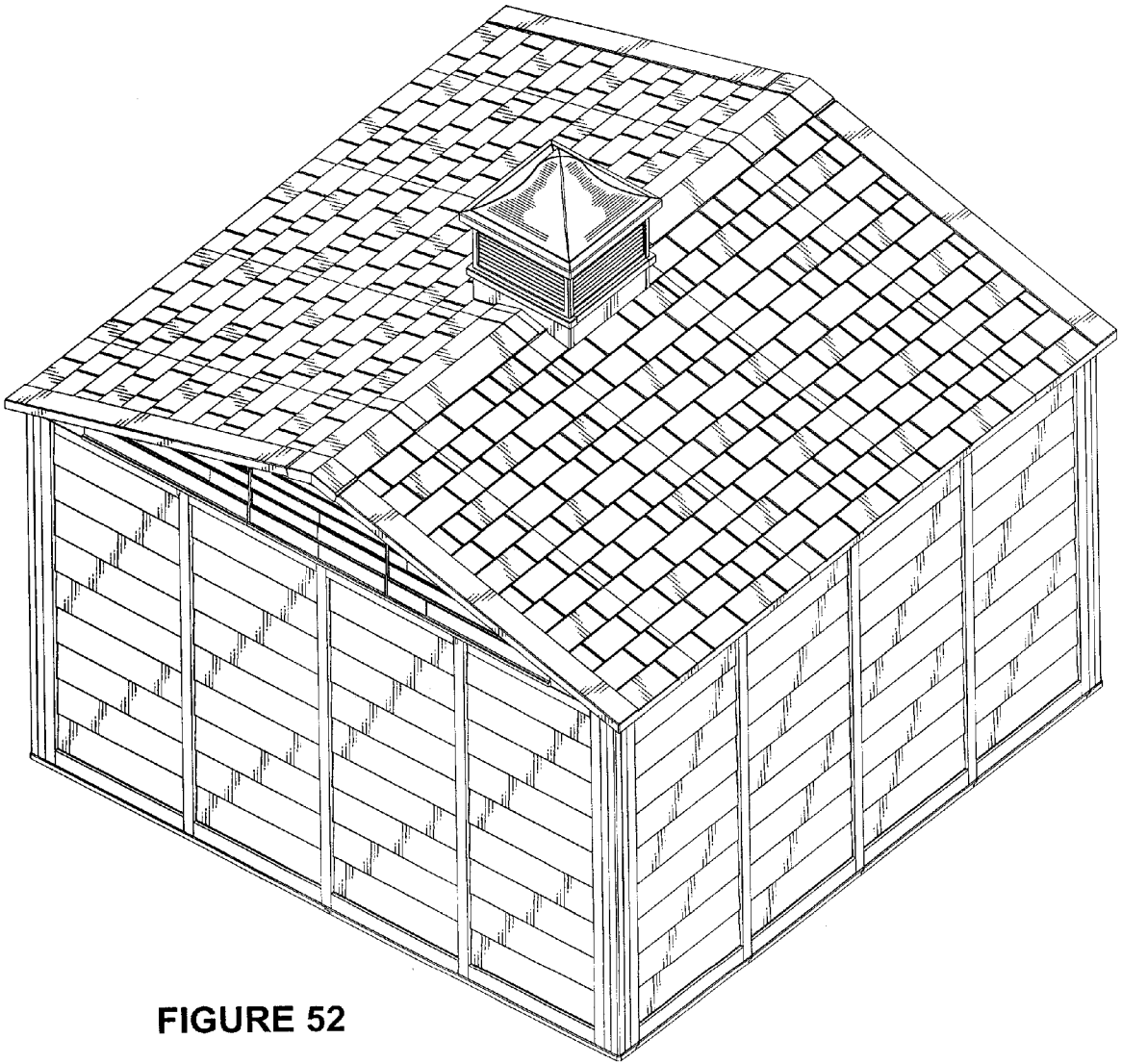
FIG. 52 is a rear perspective view of the embodiment shown in FIG. 51.
Figure 53:
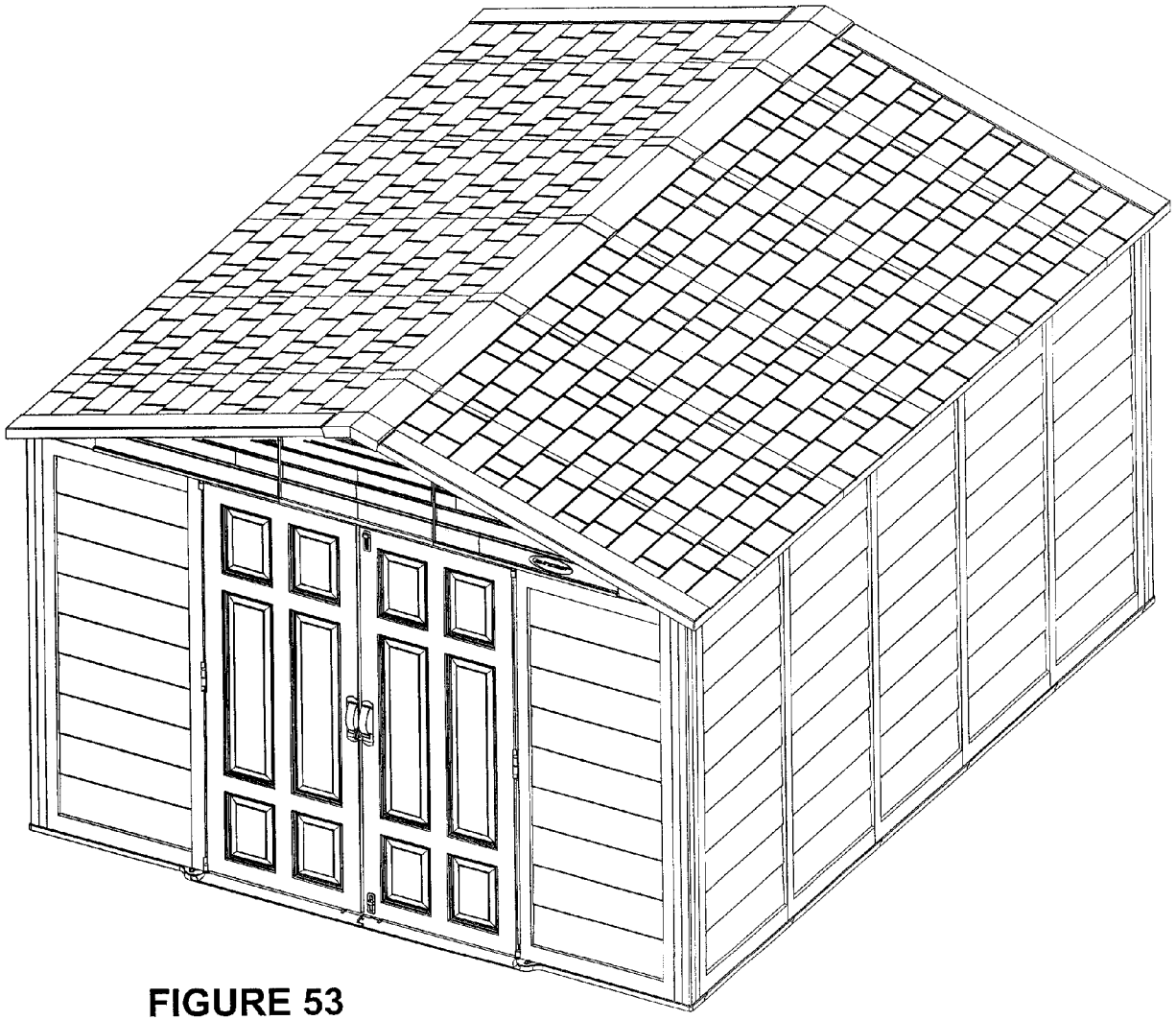
FIG. 53 is a front perspective view illustrating a larger utility enclosure constructed with the teachings of the instant invention.

Referring to FIGS. 51-53, alternative embodiments of the present invention are shown wherein the enclosures are made larger by adding floor panels, roof panels, and adding additional side wall panels. The enlarged enclosures may also include additional door panels to facilitate entering the shed at more than one position. In this manner the same construction can be utilized to build structures of varying size utilizing substantially the same components.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An injection molded utility shed comprising:

a floor assembly for enclosing the bottom of said utility shed, said floor assembly including a plurality of like-configured floor panel members, wherein each said floor member includes a first closed edge, a second edge opposite said closed edge, said second edge including a first means for connecting to juxtapositioned panel members, a third edge substantially perpendicular to and extending between said first and said second edges, said third edge including said first means for connecting to juxtapositioned panel members, a fourth edge opposite to and substantially parallel to said third edge, said fourth edge including said first means for connecting to juxtapositioned panel members, a top surface and a bottom surface, wherein said top surface includes a second means of connecting to wall panel members in a substantially perpendicular relationship with respect to said top surface, wherein at least two of said like configured floor panels may be assembled having said second edges juxtapositioned in interlocking engagement to assemble a floor assembly having a predetermined width, wherein at least two of said like configured floor panels may be assembled having said third and said fourth edges juxtapositioned in interlocking engagement to assemble a floor assembly having a predetermined length;

a pair of side wall assemblies for enclosing the left side and right side of said utility shed, wherein said pair of side wall assemblies are constructed and arranged to cooperate with said second means for connecting panel members to secure said side walls to said floor assembly in a substantially perpendicular relationship;

a rear wall assembly for enclosing the back of said utility shed, wherein said rear wall assembly is constructed and arranged to cooperate with said second means for connecting panel members to secure said rear wall assembly to said floor assembly in a substantially perpendicular relationship;

a front wall assembly for enclosing the front of said utility shed, wherein said front wall assembly is constructed and arranged to cooperate with said second means for connecting panel members to secure said front wall assembly to said floor assembly in a substantially perpendicular relationship, wherein said front wall assembly includes a door assembly for enclosing and providing ingress into and egress from said utility shed;

a roof assembly, wherein said roof assembly includes a third means of connecting, wherein said third means for connecting is constructed and arranged to cooperate with said front wall assembly and said rear wall assembly in an interlocking relationship for enclosing the top of said utility shed;

wherein said first means for connecting panel members includes a series of spaced apart fingers and recesses, wherein a portion of said fingers are provided with at least one countersunk aperture for receiving a fastener, said fingers and recesses constructed and arranged so that said fingers overlap and mateably engage the recesses of a juxtapositioned floor panel and wherein at least one fastener secures said floor panel members together in an inter-fitting engagement with their respective top surfaces in a co-planar arrangement wherein at least one of said fingers includes an alignment boss outwardly projecting from a lower surface thereof, wherein said alignment boss mateably engages an alignment socket positioned within an upper surface of at least one of said recesses wherein said alignment boss includes at least one integrally formed spring clip, wherein said spring clip is constructed and arranged to interlockingly engage said alignment socket wherein a utility shed can be shipped in a disassembled state and assembled on a desired site.

2. The utility shed of claim 1 wherein said floor assembly includes a rear end assembly, said rear end assembly including at least one rear end member, said at least one rear end member including a top surface, said top surface including said second means of attaching said floor assembly to a wall assembly, a first closed rear edge, a second edge opposite said first edge, said second edge including said first means for connecting panel members, and a pair of outer closed edges for maintaining a weather resistant enclosure, wherein said second edge of said rear end member may be juxtapositioned in interlocking engagement with said third or said fourth edges of said floor panel members.

3. The utility shed of claim 1 wherein said second means for connecting wall panel members includes a plurality of locking bosses arranged in a linear fashion adjacent to said closed edges of said floor panel members, said bosses extending upwardly from said top surface, said locking bosses constructed and arranged to cooperate with said wall assemblies for positioning engagement.

4. The utility shed of claim 3 wherein said locking bosses are removable and replaceable, wherein each said removable and replaceable locking boss includes a first boss end and a second flange end, wherein said locking boss end is inserted upwardly through a conjugately shaped aperture integrally formed within said floor panels adjacent said first closed edge so that said boss end of said locking boss extends upwardly above said top surface of said floor panel.

5. The utility shed of claim 4 wherein each said removable and replaceable locking boss includes at least one integrally formed spring clip, wherein said spring clip is constructed and arranged to cooperate with a floor panel to secure said locking boss in interlocking engagement with a floor panel.

6. The utility shed of claim 1 wherein said floor assembly includes a front end assembly, said front end assembly including at least one front end member, said at least one front end member including a top surface, said top surface including said second means of connecting said floor assembly to a wall assembly, a first ramp edge, a second edge opposite said first ramp edge, said second edge including said first means of connecting panel members, and a pair of outer closed edges for maintaining a weather resistant enclosure, wherein said second edge of said front end member may be juxtapositioned in interlocking engagement with said third or said fourth edges of said floor panel members.

7. The utility shed of claim 6 wherein said front end assembly includes two front end members, wherein one of said outer closed edges of each front end member includes a fourth means for connecting panel members, wherein said front end members are secured in a juxtaposed interlocking arrangement.

8. The utility shed of claim 7 wherein said fourth means for connecting includes an overlapping tab arrangement, wherein said overlapping tab arrangement includes at least one aperture therethrough for accepting a fastener.

9. The utility shed of claim 6 wherein said rear end assembly includes two front end members, wherein one of said outer closed edges of each front end member includes said fourth means for connecting to adjacently positioned front end members, wherein said front end members are secured in an interlocking arrangement.

10. An injection molded utility shed comprising:

a floor assembly for enclosing the bottom of said utility shed, said floor assembly including a top surface, said top surface including a second means of connecting wall panel members in a substantially perpendicular relationship with respect to said top surface;

a pair of side wall assemblies for enclosing the left side and right side of said utility shed, wherein said pair of side wall assemblies are constructed and arranged to cooperate with said second means for connecting panel members for securing said side walls to said floor assembly in a substantially perpendicular relationship;

a rear wall assembly for enclosing the back of said utility shed, wherein said rear wall assembly is constructed and arranged to cooperate with said second means for connecting panel members for securing said rear wall assembly to said floor assembly in a substantially perpendicular relationship;

a front wall assembly for enclosing the front of said utility shed, wherein said front wall assembly is constructed and arranged to cooperate with said second means for connecting panel members for securing said front wall assembly to said floor assembly in a substantially perpendicular relationship, wherein said front wall assembly includes a door assembly for enclosing and providing ingress into and egress from said utility shed;

a roof assembly for enclosing the top of said utility shed wherein said roof assembly includes at least two header assemblies, a ridge cap assembly, at least two like-constructed roof panels, wherein said header assembly includes a bottom surface, a top surface, an inner surface, and an outer surface, wherein said bottom surface includes a third means of connecting to wall panel members in a substantially co-planar relationship with respect to said outer surfaces;

wherein said third means of attachment includes a plurality of locking bosses arranged in a linear fashion adjacent to said outer surface of each said header assembly, said bosses extending downwardly from said bottom surface, said locking bosses constructed and arranged to cooperate with said fifth means of connecting formed into said wall panels for positioning thereof, wherein said bosses are slid into respective wall panel sockets until the integrally formed spring tabs engage corresponding apertures formed in the wall panel sockets;

wherein said locking bosses are removable and replaceable, wherein each said locking boss includes a first end and a second end, wherein said first end is inserted into a substantially conjugate shaped aperture integrally formed within said header assembly adjacent said outer edge until at least one integrally formed spring clip engages said header assembly, whereby said second end of said locking boss extends downwardly below said bottom surface of said header assembly;

wherein a utility shed can be shipped in a disassembled state and assembled on a desired site.

11. The injection molded utility shed of claim 10 wherein said ridge cap assembly includes a plurality of like constructed ridge cap members, wherein said ridge cap members each include an upper surface, a lower surface, a first end, a second end, and a first and second edge, wherein said first and said second end include a tenth means for connecting, wherein said tenth means for connecting is constructed and arranged to secure said ridge cap members together in an interfitting engagement, wherein said first and second edges include an eleventh means of connecting, wherein said eleventh means of connecting is constructed and arranged to secure said roof panels to said ridge cap for weather resistant engagement.

12. The utility shed of claim 10 wherein said like-constructed roof panels include a first closed edge, a second edge opposite said closed edge, said second edge including a twelfth means for connecting to ridge cap members, a third edge substantially perpendicular to and extending between said first and said second edges, said third edge including a thirteenth means for connecting to juxtapositioned roof panel members, a fourth edge opposite to and substantially parallel to said third edge, said fourth edge including a fourteenth means for connecting to juxtapositioned roof panel members, a top surface and a bottom surface, wherein said twelfth means of attachment constructed and arranged to cooperate with said eleventh means of connection on said first or said second edge of said ridge cap for weather resistant engagement, wherein said thirteenth means of connection is constructed and arranged to cooperate with said fourteenth means of connection of an adjacently positioned roof panel for weather resistant engagement, wherein said inner surface includes a fifteenth means of connection, wherein said fifteenth means of connection is constructed and arranged for securing said roof panels to said side wall panels.

13. The utility shed of claim 12 wherein said fifteenth means of connecting said roof panels to said wall panels includes a plurality of sockets arranged in a linear fashion adjacent to said first closed edge, wherein each said socket is constructed and arranged to cooperate with a first connector for attachment to said fifth means of connection in said wall panels, wherein said connector includes a first end constructed and arranged to cooperate with said fifteenth means of connection within said roof panels and a second end constructed and arranged to cooperate with said fifth means of connection within said side wall panels.

14. The utility shed of claim 10 wherein said header assembly includes a pair of end members and a center member, wherein said center member includes a first end and a second end, wherein said first end and said second end each include an ninth means of connecting, wherein said ninth means of connecting is constructed and arranged to secure said end members and said center member in an interlockingly engaged relationship.

15. The utility shed of claim 14 wherein said ninth means of connecting includes a plurality of integrally formed interfitting tubes separated by inwardly extending sockets, wherein said tubes are constructed and arranged to fit within said sockets for interlocking engagement.

16. The utility shed of claim 10 wherein said inner surface of said roof assembly is constructed and arranged to cooperate with at least one roof support beam, wherein said at least one support beam extends between said header assemblies to provide increased structural load bearing capacity to said roof assembly.

17. The injection molded utility shed of claim 16 wherein said support beam is constructed of metal.

18. The injection molded utility shed of claim 16 wherein said support beam is constructed of plastic.

19. The injection molded utility shed of claim 16 wherein said support beam is constructed of a composite material.

20. The utility shed of claim 16 wherein said inner surface of said header assemblies are constructed and arranged to cooperate with up to five said roof support beams.

* * * * *